US012734573B2

(12) United States Patent
Kobayashi et al.

(10) Patent No.: US 12,734,573 B2
(45) Date of Patent: Sep. 15, 2026

(54) HOT STAMPING MEMBER

(71) Applicant: NIPPON STEEL CORPORATION, Tokyo (JP)

(72) Inventors: Akinobu Kobayashi, Tokyo (JP); Yuji Sakiyama, Tokyo (JP); Takayuki Harano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 687 days.

(21) Appl. No.: 17/910,749

(22) PCT Filed: May 13, 2021

(86) PCT No.: PCT/JP2021/018154
§ 371 (c)(1),
(2) Date: Feb. 16, 2023

(87) PCT Pub. No.: WO2021/230306
PCT Pub. Date: Nov. 18, 2021

(65) Prior Publication Data

US 2023/0182190 A1 Jun. 15, 2023

(30) Foreign Application Priority Data

May 13, 2020 (JP) ..... 2020-084583

(51) Int. Cl.
*B21D 22/02* (2006.01)
*C22C 38/02* (2006.01)
(Continued)

(52) U.S. Cl.
CPC ..... *B21D 22/022* (2013.01); *C22C 38/02* (2013.01); *C22C 38/04* (2013.01); *C22C 38/06* (2013.01)

(58) Field of Classification Search
CPC ... B21D 22/022; B32B 15/012; B32B 15/015; C21D 1/18; C21D 1/26; C21D 1/673;
(Continued)

(56) References Cited

U.S. PATENT DOCUMENTS

2006/0147336 A1 7/2006 Sugahara
2010/0003163 A1 1/2010 Kloewer et al.
(Continued)

FOREIGN PATENT DOCUMENTS

CN 107429342 A 12/2017
CN 107904535 A 4/2018
(Continued)

OTHER PUBLICATIONS

Ungár et al., "The contrast factors of dislocations in cubic crystals: the dislocation model of strain anisotropy in practice", J. Appl. Cryst. (1999), 32, pp. 992-1002.

*Primary Examiner* — Rebecca Janssen
*Assistant Examiner* — Mayela Aldaz
(74) *Attorney, Agent, or Firm* — Birch, Stewart, Kolasch & Birch, LLP

(57) ABSTRACT

A hot stamping member including a base material and a plating layer provided on the base material, wherein the plating layer has a Ni-rich region, an Al-rich region and an Fe-rich region in this order from a surface of the plating layer, in a region from the surface of the plating layer to a 100 nm position in the thickness direction from the surface of the plating layer, Ni and Fe satisfy predetermined contents, in a region from the 100 nm position in the thickness direction from the surface of the plating layer to a 500 nm position in the thickness direction from the surface of the plating layer, Ni and Fe satisfy predetermined contents, and, in a region from the 500 nm position to a 1000 nm position
(Continued)

in the thickness direction from the surface of the plating layer, Ni and Fe satisfy predetermined contents.

7 Claims, 3 Drawing Sheets

(51) Int. Cl.
*C22C 38/04* (2006.01)
*C22C 38/06* (2006.01)

(58) Field of Classification Search
CPC .... C21D 8/005; C21D 9/0068; C22C 38/002; C22C 38/005; C22C 38/02; C22C 38/04; C22C 38/06; C22C 38/12; C22C 38/14; C22C 38/22; C22C 38/26; C22C 38/28; C22C 38/32; C22C 38/38; C23C 2/12; C23C 28/02; C23C 28/028
See application file for complete search history.

(56) References Cited

U.S. PATENT DOCUMENTS

| | | | | |
|---|---|---|---|---|
| 2014/0030544 | A1* | 1/2014 | Maki | C22C 38/04 428/653 |
| 2016/0059343 | A1 | 3/2016 | Nam et al. | |
| 2016/0222485 | A1 | 8/2016 | Murakami et al. | |
| 2017/0253941 | A1 | 9/2017 | Cobo et al. | |
| 2018/0029102 | A1 | 2/2018 | Omori et al. | |
| 2019/0144963 | A1* | 5/2019 | Georges | C21D 6/005 428/667 |
| 2020/0024683 | A1 | 1/2020 | Yokoi et al. | |
| 2020/0131596 | A1 | 4/2020 | Takashima et al. | |

FOREIGN PATENT DOCUMENTS

| | | | |
|---|---|---|---|
| EP | 3 712 293 | A1 | 9/2020 |
| JP | H0 4-246182 | A | 9/1992 |
| JP | H0 6-346277 | A | 12/1994 |
| JP | H 11-269664 | A | 10/1999 |
| WO | WO 2016/016707 | A1 | 2/2016 |
| WO | WO 2017/187255 | A1 | 11/2017 |
| WO | WO 2019/003543 | A1 | 1/2019 |
| WO | WO 2021/230309 | A1 | 11/2021 |
| WO | WO 2021/230311 | A1 | 11/2021 |

* cited by examiner

HOT STAMPING MEMBER

TECHNICAL FIELD

The present invention relates to a hot stamping member. Priority is claimed on Japanese Patent Application No. 2020-084583, filed May 13, 2020, the content of which is incorporated herein by reference.

BACKGROUND ART

In recent years, there has been a demand for the weight reduction of automotive vehicle bodies from the viewpoint of environmental protection and resource saving, and the application of high strength steel sheets to automotive members has been accelerating. Automotive members are manufactured by press forming, and an increase in the strength of steel sheets does not only increase forming loads but also degrades formability, which creates a problem with the formability of high strength steel sheets into members with a complicated shape. In order to solve such a problem, the application of hot stamping techniques, in which a steel sheet is heated to a high temperature in an austenite region where the steel sheet softens and then formed by pressing, is underway. Hot stamping is drawing attention as a technique in which a quenching treatment is carried out in a die at the same time as pressing, thereby satisfying both formability into automotive members and the securement of the strength of automotive members.

In a case where hot stamping is carried out on a steel sheet that is a bare material on which plating or the like has not been carried out, there is a need to carry out hot stamping in a non-oxidative atmosphere in order to suppress the formation of scale during heating and the decarburization of the surface layer. However, even when hot stamping is carried out in a non-oxidative atmosphere, the steel sheet is in the atmospheric atmosphere when the steel sheet is conveyed from a heating furnace to a pressing machine, thus, a scale is formed on the surface of the hot-stamped steel sheet. The scale on the surface of the steel sheet is poorly adhesive and easily exfoliates, which creates a concern of an adverse influence on other steps. Therefore, there is a need to remove the scale by shot blasting or the like. Shot blasting has a problem of affecting the shapes of steel sheets. In addition, there is a problem in that the productivity of a hot stamping step deteriorates due to a scale removal step.

In order to improve the adhesion of scale on the surface of a steel sheet, there is a method in which Al plating or Zn plating is formed on the surface of the steel sheet. When Al plating or Zn plating is formed, since scale that is formed on the surface of a steel by hot stamping has favorable adhesion, a step of removing scale becomes unnecessary. Therefore, the productivity of the hot stamping step is improved.

In a case where Al plating is provided on a steel sheet, a reaction is caused between Al and water on the surface of the Al plating during hot stamping, and hydrogen is generated. Therefore, there is a problem in that the amount of intruding hydrogen into the steel sheet is large. When the amount of hydrogen intruding into the steel sheet is large, stress that is loaded after hot stamping leads to cracking of the steel sheet (hydrogen embrittlement).

In order to reduce the amount of intruding hydrogen in a steel sheet provided with Al plating, for example, Patent Document 1 discloses a technique for enriching the surface region of a steel sheet with nickel.

In addition, Patent Document 2 discloses a technique for coating a steel sheet with a barrier pre-coat containing nickel and chromium and having a weight ratio Ni/Cr of 1.5 to 9.

CITATION LIST

Patent Document

Patent Document 1: PCT International Publication No. WO 2016/016707

Patent Document 2: PCT International Publication No. WO 2017/187255

Patent Document 3: Japanese Unexamined Patent Application, First Publication No. H11-269664

Patent Document 4: Japanese Unexamined Patent Application, First Publication No. H4-246182

SUMMARY OF THE INVENTION

Problems to be Solved by the Invention

However, in a case where a hot stamping member is produced by the hot stamping of the steel sheet described in Patent Document 1 or Patent Document 2, since there is a potential difference between Al and Ni on the surface of the hot stamping member, there is a problem in that corrosion of the hot stamping member proceeds.

The present invention has been made in consideration of the above-described problem, and an objective of the present invention is to provide a hot stamping member having excellent corrosion resistance even when having a plating layer containing Ni and Al on the surface of the hot stamping member.

Means for Solving the Problem

As a result of intensive studies, the present inventors found that, when a Ni layer is provided on the surface of an Al plating layer, and a heat treatment during hot stamping is controlled, it is possible to suppress the diffusion of Fe into the outermost surface of a hot stamping member and to suppress the corrosion of the hot stamping member. In addition, similarly, it was found that, when the heat treatment during hot stamping is controlled to appropriately alloy Al and Ni, it is possible to suppress corrosion attributed to the potential difference between Al and Ni.

The present invention has been made by further progressing studies based on the above-described finding, and the gist thereof is as described below.

(1) A hot stamping member according to one aspect of the present invention is a hot stamping member including a base material and a plating layer provided on the base material, in which the plating layer has a Ni-rich region where a Ni content is 50 mass % or more, an Al-rich region where a Ni content is less than 50 mass %, an Al content is 10 mass % or more and an Fe content is 50 mass % or less, and an Fe-rich region where an Al content is 10 mass % or more and an Fe content is more than 50 mass % in this order from a surface of the plating layer, in a region from the surface of the plating layer to a 100 nm position in a thickness direction from the surface of the plating layer, a maximum value of a Ni content is 50 mass % or more, and an Fe content is 10 mass % or less, in a region from the 100 nm position in the thickness direction from the surface of the plating layer to a 500 nm position in the thickness direction from the surface of the plating layer, a maximum value of a Ni content is 5 mass % or more, and an Fe content is 25 mass % or less, and in a region from the 500 nm position in the thickness direction from the surface of the plating layer to a 1000 nm position in the thickness direction from the surface of the plating layer, a maximum value of a Ni content is 1 mass % or more, and an Fe content is 30 mass % or less.

(2) The hot stamping member according to (1), in which, in a region from the surface of the plating layer to a 20 nm position in the thickness direction from the surface of the plating layer, at least one of a Ni oxide and a Ni hydroxide may be present, and a Ni content may be 30 mass % or more.

(3) The hot stamping member according to (1) or (2), in which the chemical composition of the base material may be, by mass %, C: 0.01% or more and less than 0.70%,
Si: 0.005% to 1.000%,
Mn: 0.15% to 3.00%,
sol. Al: 0.00020% to 0.50000%,
P: 0.100% or less,
S: 0.1000% or less,
N: 0.0100% or less,
Cu: 0% to 1.00%,
Ni: 0% to 1.00%,
Nb: 0% to 0.150%,
V: 0% to 1.000%,
Ti: 0% to 0.150%,
Mo: 0% to 1.000%,
Cr: 0% to 1.000%,
B: 0% to 0.0100%,
Ca: 0% to 0.010%,
REM: 0% to 0.300%, and
a remainder: Fe and an impurity, (4) The hot stamping member according to (3), in which the chemical composition of the base material may contain, by mass %, one or two or more selected from the group consisting of:

Cu: 0.005% to 1.00%,
Ni: 0.005% to 1.00%,
Nb: 0.010% to 0.150%,
V: 0.005% to 1.000%,
Ti: 0.010% to 0.150%,
Mo: 0.005% to 1.000%,
Cr: 0.050% to 1.000%,
B: 0.0005% to 0.0100%,
Ca: 0.001% to 0.010%, and
REM: 0.001% to 0.300% or less.

Effects of the Invention

According to the above-described aspect of the present invention, it is possible to provide a hot stamping member having excellent corrosion resistance even when having a plating layer containing Ni and Al on the surface of the hot stamping member.

EMBODIMENT(S) FOR IMPLEMENTING THE INVENTION

<Hot Stamping Member>

Figure 1:
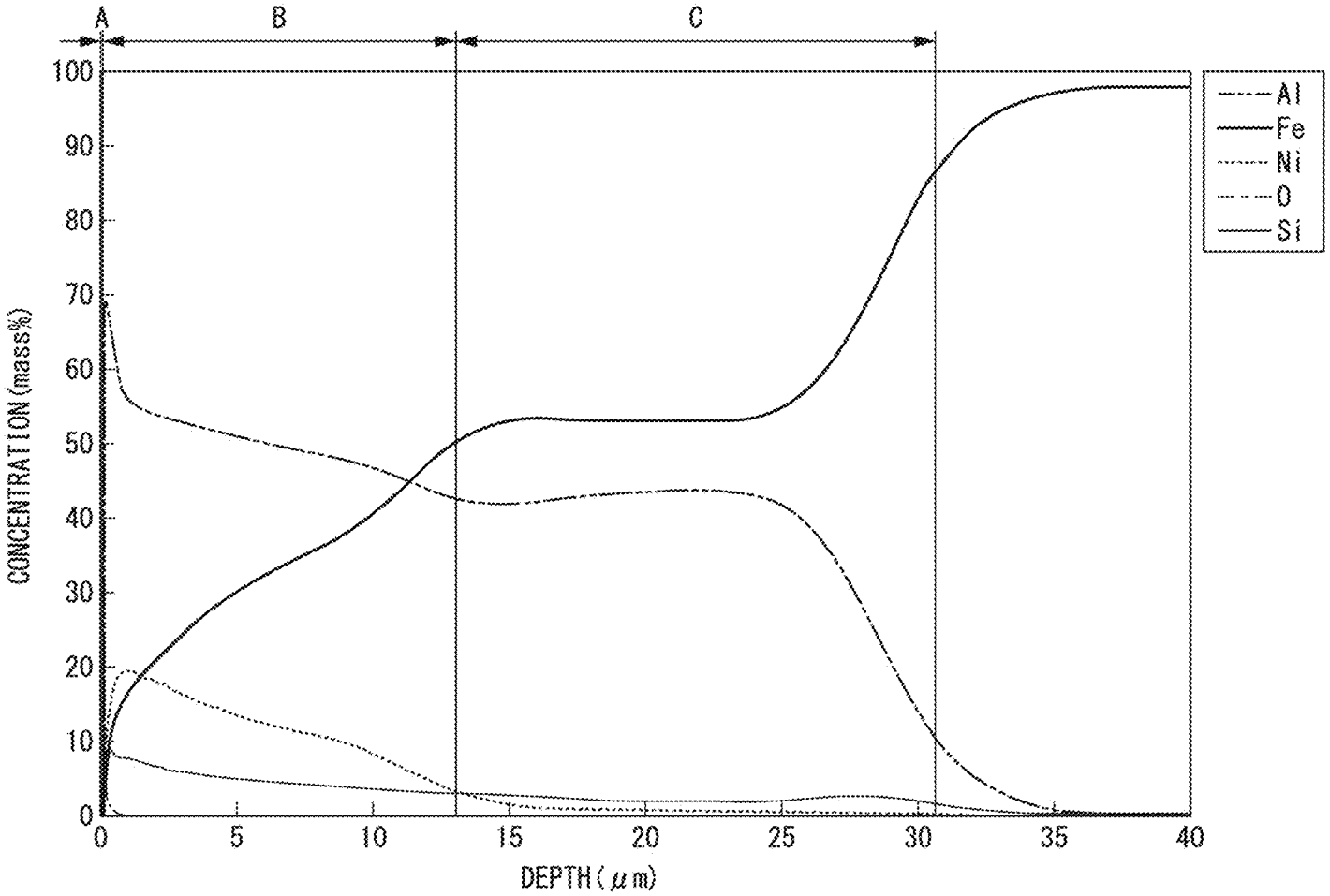
FIG. 1 is a profile in a depth direction of a plating layer according to an embodiment of the present invention.

As a result of intensive studies, the present inventors found that, in order to obtain excellent corrosion resistance, it is important to control the distributions of Al, Ni and Fe in the depth direction in a plating layer of a hot stamping member by producing an Al-plated steel sheet including a Ni plating layer on the surface of an Al plating layer and, furthermore, appropriately carrying out a heat treatment during hot stamping.

As a result of additional intensive studies, the present inventors obtained the following findings.

(A) When a hot stamping member includes a plating layer, and the plating layer includes a Ni-rich region where the Ni content is 50 mass % or more, an Al-rich region where the Ni content is less than 50 mass %, the Al content is 10 mass % or more and the Fe content is 50 mass % or less and an Fe-rich region where the Al content is 10 mass % or more and the Fe content is more than 50 mass %, it is possible to suppress the corrosion of the hot stamping member.

(B) When the maximum value of the Ni content is set to 50 mass % or more and the Fe content is set to 10 mass % or less in a region from the surface of the plating layer to a 100 nm position in the thickness direction from the surface of the plating layer, it is possible to suppress the corrosion of the hot stamping member.

(C) When the maximum value of the Ni content is set to 5 mass % or more and the Fe content is set to 25 mass % or less in a region from the 100 nm position in the thickness direction from the surface of the plating layer to a 500 nm position in the thickness direction from the surface of the plating layer, it is possible to suppress the corrosion of the hot stamping member.

(D) When the maximum value of the Ni content is set to 1 mass % or more and the Fe content is set to 30 mass % or less in a region from the 500 nm position in the thickness direction from the surface of the plating layer to a 1000 nm position in the thickness direction from the surface of the plating layer, it is possible to suppress the corrosion of the hot stamping member.

In a hot stamping member according to the present embodiment, the configuration of the hot stamping member was determined based on the above-described findings. In the hot stamping member according to the present embodiment, an intended effect of the present invention can be obtained due to the synergistic effects of the above-mentioned configurations. The hot stamping member according to the present embodiment includes a base material and a plating layer provided on the base material. As techniques for providing Ni plating on Al plating, there was a technique by which Ni plating is provided on Al plating in order to suppress the wear of an electrode at the time of resistance welding as in Patent Documents 3 and 4. However, in a hot stamping member obtained by hot-stamping a steel sheet provided with Al plating, an Al oxide coating is formed on the surface of the Al plating on the surface. Therefore, when an Al-plated steel sheet is hot-stamped, Al erodes (diffuses) toward a welding electrode (usually, a Cu—Cr alloy is used), and there is no case where a Cu—Al—Fe-based intermetallic compound is formed at the tip end portion of the welding electrode. Even when resistance welding is carried out on a hot stamping member obtained by hot-stamping an Al-plated steel sheet, the welding electrode is hardly consumed. Therefore, there has been no motivation for using an expensive steel sheet having Ni plating provided on Al plating in hot stamping using Patent Documents 3 and 4. Therefore, there have been no hot stamping members that can be manufactured by hot-stamping a steel sheet having Ni plating provided on Al plating. In the present specification, numerical ranges expressed using "to" include numerical values before and after "to" as the lower limit value and the upper limit value. Numerical values expressed with "more than" and "less than" are not included in numerical ranges. Regarding chemical compositions, "%" indicates "mass %" in all cases.

(Plating Layer)

The structure of the plating layer of the hot stamping member according to the present embodiment will be described using FIG. 1. FIG. 1 is a depth profile of the plating layer of the hot stamping member. The vertical axis of FIG. 1 indicates the content (mass %) of each element, and the horizontal axis indicates the depth from the outermost surface of the hot stamping member (outermost surface: 0 μm). In the depth profile, Fe contents where contents of 5% or more are detected, Al contents, Ni contents, Si contents and O contents are shown in FIG. 1. In this example, the Ni content decreases up to approximately 10 mass % at a depth of near 0.1 μm, and furthermore, the Ni content increases as the depth increases. The reason therefor is not clear, but the following reasons are conceivable. Since a dense Ni oxide coating is formed near the surface of the hot stamping member, and Al is not diffused into the Ni oxide coating, the surface becomes a high-concentration Ni region. Incidentally, an Al oxide is formed in the following region of the Ni oxide coating, and oxygen increases, whereby a decrease in the Ni content is noticeable when detected elements are expressed as percentages. Since Al reacts with oxygen more easily than Ni, it is considered that Al diffuses into the surface, consequently, the Ni content decreases up to approximately 10 mass % at a depth of near 0.1 μm, and furthermore, the Ni content increases as the depth increases.

The Ni-rich region where the Ni content of the plating layer of the hot stamping member reaches 50 mass % or more is a region A in FIG. 1. The Al-rich region where the Ni content is less than 50 mass %, the Al content is 10 mass % or more and the Fe content is 50 mass % or less is a region B in FIG. 1. The Fe-rich region where the Al content is 10 mass % or more and the Fe content is more than 50 mass % is a region C in FIG. 1. When the Ni-rich region where the Ni content reaches 50 mass % or more is present on the outermost surface of the hot stamping member, and the Ni-rich region, the Al-rich region and the Fe-rich region are present in the plating layer in this order, it is possible to suppress the corrosion of the hot stamping member. The thickness of the plating layer of the hot stamping member is calculated from the total of the thicknesses of individual regions of the Ni-rich region, the Al-rich region and the Fe-rich region.

Next, the structure of the hot stamping member according to the present embodiment from the surface of the plating layer to a 1000 nm position in the thickness direction from the surface of the plating layer will be described using FIG. 2. The vertical axis of FIG. 2 indicates the content (mass %) of each element, and the horizontal axis indicates the depth from the outermost surface of the hot stamping member (outermost surface: 0 μm). In the depth profile, Fe contents, Al contents, Ni contents, Si contents and O contents where contents of 5% or more are detected are shown in FIG. 2.

Figure 2:
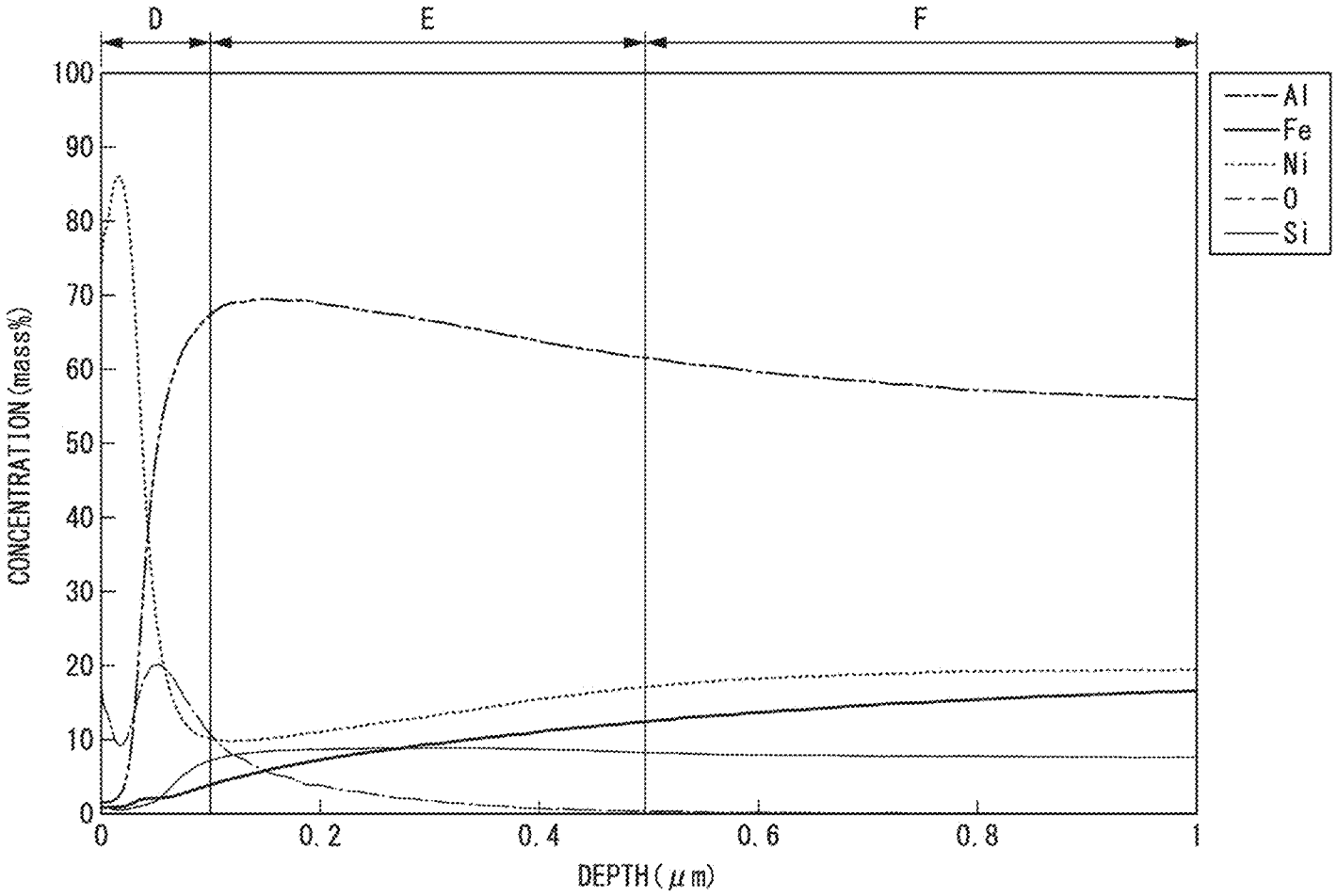
FIG. 2 is a profile from a surface of the plating layer according to the embodiment of the present invention to a 1000 nm position of the plating layer.
Figure 3:
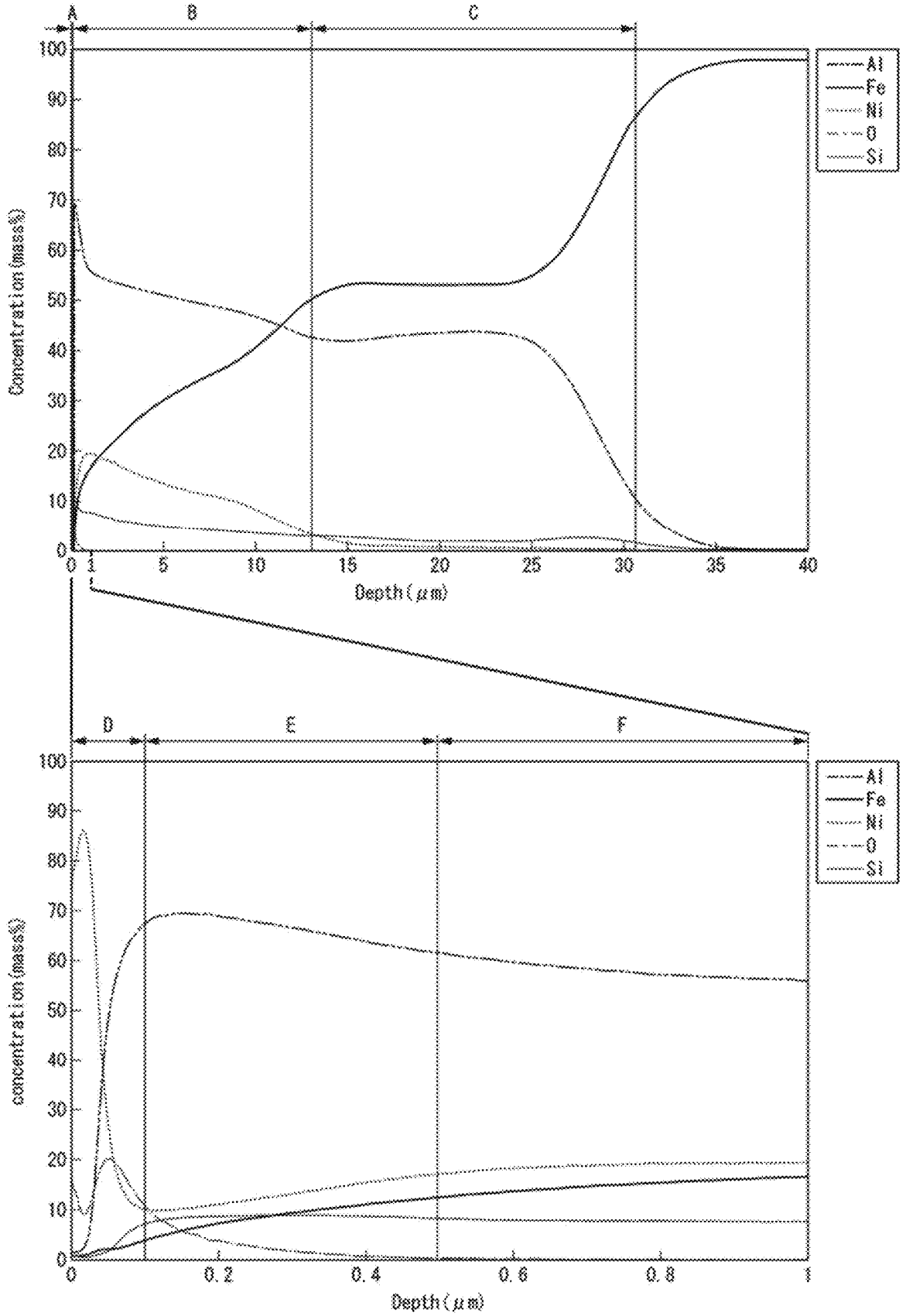
FIG. 3 is a profile in a depth direction of a plating layer according to an embodiment of the present invention, based on combined FIGS. 1 and 2.

A region from the surface of the plating layer to the 100 nm position in the thickness direction from the surface of the plating layer of the hot stamping member according to the present embodiment is a region D in FIG. 2. A region from the 100 nm position in the thickness direction from the surface of the plating layer to a 500 nm position in the thickness direction from the surface of the plating layer of the hot stamping member is a region E in FIG. 2. A region from the 500 nm position in the thickness direction from the surface of the plating layer to a 1000 nm position in the thickness direction from the surface of the plating layer is a region F in FIG. 2. As shown in FIG. 3, FIG. 2 shows an enlarged view of the depth range of 0-1 μm shown in FIG. 1. Hereinafter, each region will be described.

"Region from Surface of Plating Layer to 100 nm Position in Thickness Direction from Surface of Plating Layer"

In the region from the surface of the plating layer of the hot stamping member to the 100 nm position in the thickness direction from the surface of the plating layer of the hot stamping member, the maximum value of the Ni content is 50 mass % or more and the Fe content is 10 mass % or less. In the region from the surface of the plating layer to the 100 nm position in the thickness direction from the surface of the plating layer, the Al content may be set to 1 mass % or more.

In a case where the maximum value of the Ni content is less than 50 mass % in the region from the surface of the plating layer of the hot stamping member to the 100 nm position in the thickness direction from the surface of the plating layer of the hot stamping member, the Al content or the Fe content in the outermost surface of the hot stamping member becomes excessively large, and the corrosion resistance of the hot stamping member deteriorates. Therefore, the maximum value of the Ni content is 50 mass % or more. A more preferable maximum value of the Ni content is 70 mass % or more. The Ni content may be set to 90 mass % or less.

In a case where the Fe content is more than 10 mass % in the region from the surface of the plating layer of the hot stamping member to the 100 nm position in the thickness direction from the surface of the plating layer of the hot stamping member, Fe that causes the corrosion of the hot stamping member is excessively present on the outermost surface of the hot stamping member, and the red rust resistance of the hot stamping member deteriorates. Therefore, the Fe content is 10 mass % or less. A more preferable Fe content is 5 mass % or less.

In a case where the maximum value of the Al content is less than 1 mass % in the region from the surface of the plating layer of the hot stamping member to the 100 nm position in the thickness direction from the surface of the plating layer of the hot stamping member, there is a case where an intermetallic compound of Ni and Al, which improves the white rust resistance of the hot stamping member, is not formed. Therefore, the maximum value of the Al content is preferably set to 1 mass % or more. A more preferable maximum value of the Al content is 5 mass % or more. The Al content may be 80 mass % or less. In the region from the surface of the plating layer to the 100 nm position in the thickness direction from the surface of the plating layer, the Cr content may be set to 6 mass % or less, 4 mass % or less, 2 mass % or less or 1 mass % or less, and the ratio (Ni/Cr) of the Ni content (mass %) to the Cr content (mass %) may be 10 or more, 15 or more, 30 or more or 50 or more.

"Region from 100 nm Position in Thickness Direction from Surface of Plating Layer to 500 nm Position in Thickness Direction from Surface of Plating Layer"

In the region from the 100 nm position in the thickness direction from the surface of the plating layer of the hot stamping member to the 500 nm position in the thickness direction from the surface of the plating layer of the hot stamping member, the maximum value of the Ni content is 5 mass % or more and the Fe content is 25 mass % or less.

In a case where the maximum value of the Ni content is less than 5 mass % in the region from the 100 nm position in the thickness direction from the surface of the plating layer of the hot stamping member to the 500 nm position in the thickness direction from the surface of the plating layer of the hot stamping member, an intermetallic compound of Ni and Al, which improves the white rust resistance of the hot stamping member, is not formed. Therefore, the maximum value of the Ni content is 5 mass % or more. A more preferable maximum value of the Ni content is 10% or more.

In a case where the Fe content is more than 25 mass % in the region from the 100 nm position in the thickness direction from the surface of the plating layer of the hot stamping member to the 500 nm position in the thickness direction from the surface of the plating layer of the hot stamping member, the Fe content becomes excessive on the outermost surface of the hot stamping member. Therefore, the Fe content is 25 mass % or less. A more preferable Fe content is 15 mass % or less.

In the region from the 100 nm position in the thickness direction from the surface of the plating layer of the hot stamping member to the 500 nm position in the thickness direction from the surface of the plating layer of the hot stamping member, the remainder is Al, Si and an impurity. As the impurity, exemplified is an element that is incorporated from a steel raw material or a scrap and/or in a process for manufacturing the hot stamping member according to the present embodiment or intentionally added and is permitted to an extent that the properties of the hot stamping member are not impaired.

"Region from 500 nm Position in Thickness Direction from Surface of Plating Layer to 1000 nm Position in Thickness Direction from Surface of Plating Layer"

In the region from the 500 nm position in the thickness direction from the surface of the plating layer of the hot stamping member to the 1000 nm position in the thickness direction from the surface of the plating layer of the hot stamping member, the maximum value of the Ni content is 1 mass % or more and the Fe content is 30 mass % or less.

In a case where the maximum value of the Ni content is less than 1 mass % in the region from the 500 nm position in the thickness direction from the surface of the plating layer of the hot stamping member to the 1000 nm position in the thickness direction from the surface of the plating layer of the hot stamping member, there is a possibility that heating during hot stamping may not be sufficiently carried out. Therefore, the adhesion between the Ni plating and the Al plating after hot stamping becomes insufficient, and there is a possibility that the Ni plating and the Al plating may exfoliate from each other. Therefore, the maximum value of the Ni content is 1 mass % or more. A more preferable maximum value of the Ni content is 5 mass % or more. The maximum value of the Ni content may be 30 mass % or less.

In a case where the Fe content is more than 30 mass % in the region from the 500 nm position in the thickness direction from the surface of the plating layer of the hot stamping member to the 1000 nm position in the thickness direction from the surface of the plating layer of the hot stamping member, the Fe content becomes excessive on the outermost surface of the hot stamping member. Therefore, the Fe content is 30 mass % or less. A more preferable Fe content is 20 mass % or less.

In the region from the 500 nm position in the thickness direction from the surface of the plating layer of the hot stamping member to the 1000 nm position in the thickness direction from the surface of the plating layer of the hot stamping member, the remainder is Al, Si and an impurity. As the impurity, an element that is incorporated from a steel raw material or a scrap and/or in a process for manufacturing the hot stamping member according to the present embodiment or intentionally added and is permitted to an extent that the properties of the hot stamping member are not impaired is an exemplary example.

The depth profile of each element in the plating layer of the hot stamping member can be measured by glow discharge spectrometry (GDS). The depth profile can be measured under discharge conditions of 35 W (constant power mode), an Ar pressure during the measurement of 600 Pa and a discharge range of 4 mmϕ. The inter-electrode distance is set to 0.15 mm to 0.25 mm, and the depth profile may be measured by selecting and applying high frequencies, direct glows, high-frequency glows or the like from the rear surface of a sample. The depth profile may be measured at a discharge voltage of 30 W to 50 W (constant power mode) and an Ar pressure during the measurement of 500 Pa to 700 Pa. The depth profile may be measured in a discharge range of 2 mmϕ to 6 mmϕ. Regarding the measurement time at one site, the measurement is carried out for a time during which 90 mass % or more of Fe is detected (represented by $\alpha$), and the measurement may be further carried out for a time of approximately 20% of the above-described time ($\alpha \times 0.2$) (total: $\alpha + 0.2\ \alpha$). When the measurement is carried out from the outermost surface of the hot stamping member to a region where the Fe element in the base material is stabilized, the depth profile of each element can be obtained. The depth (nm) from the surface of the plating layer is obtained as described below. First, a depth that is scraped per unit time is calculated from the depth scraped from the start to the end of the measurement and the measurement time. Next, the obtained depth that is scraped per unit time is multiplied by the measurement time, thereby calculating the depth from the surface of the plating layer of the hot stamping member. In the obtained depth profile, a region where the Ni content reaches 50 mass % or more is regarded as the Ni-rich region, a region that is in contact with the Ni-rich region and where the Ni content is less than 50 mass %, the Al content is 10 mass % or more and the Fe content is 50 mass % or less is regarded as the Al-rich region, and a region that is in contact with the Al-rich region and where the Al content is 10 mass % or more and the Fe content is more than 50 mass % is regarded as the Fe-rich region.

"Ni Oxide and Ni Hydroxide on Surface of Plating Layer"

In a region from the surface of the plating layer to a 20 nm position in the thickness direction from the surface of the plating layer of the hot stamping member, at least one of a Ni oxide and a Ni hydroxide may be present. This is because, when at least one of a Ni oxide and a Ni hydroxide is present on the surface of the plating layer, the chemical conversion property and the electrodeposition coating property become favorable. As the Ni oxide, NiO or $Ni_2O_3$ is an exemplary example. As the Ni hydroxide, NiOH or $Ni(OH)_2$ is an exemplary example.

"Ni Content being 30 Mass % or More in Region from Surface of Plating Layer to 20 nm Position in Thickness Direction from Surface of Plating Layer"

In the region from the surface of the plating layer of the hot stamping member to the 20 nm position in the thickness direction from the surface of the plating layer of the hot stamping member, the Ni content is preferably 30 mass % or more. When the Ni content is 30 mass % or more, it is possible to further suppress the Fe content on the outermost surface of the hot stamping member. A more preferable Ni content is 40 mass % or more.

The presence of the Ni oxide and the Ni hydroxide can be confirmed by X-ray photoelectron spectroscopy measurement (XPS measurement). Specifically, the hot stamping member is sputtering-etched by Ar sputtering (accelerating voltage: 20 kV, sputtering rate: 1.0 nm/min), and then XPS measurement is carried out. The XPS measurement is carried out by scanning the outermost surface of the hot stamping member in the entire energy range using Quantum 2000 manufactured by ULVAC-PHI, Inc. and Al Kα rays as a radiation source under conditions of an output of 15 kV, 25 W, a spot size of 100 μm and the number of times of scanning of 10 times. The Ar sputtering etching and the XPS measurement are alternately carried out, and these measurements are repeated up to the 20 nm position in the thickness direction from the plating layer. The depth from the surface of the plating layer is calculated from the sputtering etching time and the sputtering rate. The sputtering etching rate is obtained in terms of $SiO_2$. In a case where a peak is detected at 854 eV to 857 eV that are derived from the 2p orbit of the Ni oxide or the Ni hydroxide in the region from the surface of the plating layer to the 20 nm position in the thickness direction from the surface of the plating layer of the hot stamping member, at least one of the Ni oxide and the Ni hydroxide is determined to be present in the region from the surface of the plating layer to the 20 nm position in the thickness direction from the surface of the plating layer of the hot stamping member. More specifically, regarding the presence or absence of the Ni oxide or the Ni hydroxide, the XPS measurement of a sample is carried out by the above-described method, and the background is measured after the sample is removed. After that, the background is removed from the measurement data of the sample. In a case where a peak of 1000 c/s or more is detected at a portion corresponding to the peak of the Ni oxide or the Ni hydroxide at 854 eV to 857 eV after the removal of the background data, the Ni oxide or the Ni hydroxide is determined to be present. The Ni content in the region from the surface of the plating layer to the 20 nm position in the thickness direction from the surface of the plating layer of the hot stamping member is obtained by calculation from all elements detected by the XPS measurement.

"Thickness of Plating Layer"

The thickness of the plating layer of the hot stamping member is the total of the thicknesses of individual regions of the Ni-rich region, the Al-rich region and the Fe-rich region. In a case where the thickness of the plating layer of the hot stamping member is less than 5 μm, there is a case where sufficient corrosion resistance cannot be obtained. Therefore, the thickness of the plating layer is preferably 5 μm or more. In a case where the thickness of the plating layer is more than 200 μm, an effect on improvement in the corrosion resistance is saturated. Therefore, the thickness of the plating layer is preferably set to 200 μm or less. The thickness of the Ni-rich region is preferably 0.025 μm or more. The thickness of the Ni-rich region is preferably 2 μm or less. When the thickness of the Ni-rich region is 0.025 μm to 2 μm, it is possible to further suppress the corrosion of the hot stamping member. The thickness of the Ni-rich region may be 0.03 μm or more or 0.04 μm or more. The thickness of the Ni-rich region may be 2 μm or less, 1 μm or less, 0.5 μm or less, 0.3 μm or less, 0.2 μm or less, 0.10 μm or less or 0.05 μm or less. The thickness of the Al-rich region is preferably 5 μm or more. The thickness of the Al-rich region is preferably 140 μm or less. When the thickness of the Al-rich region is 5 μm to 140 μm, it is possible to further suppress the corrosion of the hot stamping member. The thickness of the Al-rich region may be 7 μm or more, 9 μm or more or 12 μm or more. The thickness of the Al-rich region may be 100 μm or less, 60 μm or less, 30 μm or less, 20 μm or less or 15 μm or less. The thickness of the Fe-rich region is preferably 2 μm or more. The thickness of the Fe-rich region is preferably 150 μm or less. When the thickness of the Fe-rich region is 2 μm to 150 μm, it is possible to further suppress the corrosion of the hot stamping member. The thickness of the Fe-rich region may be 3 μm or more, 5 μm or more or 8 μm or more. The thickness of the Fe-rich region may be 80 μm or less, 50 μm or less, 30 μm or less or 20 μm or less.

(Base Material)

The chemical composition of the base material of the hot stamping member according to the present embodiment is preferably, by mass %, C: 0.01% or more and less than 0.70%, Si: 0.005% to 1.000%, Mn: 0.15% to 3.00%, sol. Al: 0.0002% to 0.5000%, P: 0.100% or less, S: 0.1000% or less, N: 0.0100% or less, Cu: 0% to 1.00%, Ni: 0% to 1.00%, Nb: 0% to 0.150%, V: 0% to 1.000%, Ti: 0% to 0.150%, Mo: 0% to 1.000%, Cr: 0% to 1.000%, B: 0% to 0.0100%, Ca: 0% to 0.010%, REM: 0% to 0.300%, and a remainder: Fe and an impurity.

"C: 0.01% or More and Less than 0.70%"

C is an important element for securing hardenability. When the C content of the base material is less than 0.01%, it becomes difficult to obtain sufficient hardenability, and the strength decreases. Therefore, the C content of the base material is preferably set to 0.01% or more. The C content of the base material may be 0.08% or more, 0.18% or more or 0.25% or more. On the other hand, when the C content of the base material is 0.70% or more, a coarse carbide is formed, and brittle fracture is likely to occur. Therefore, the C content is preferably set to less than 0.70%. The C content of the base material is preferably 0.38% or less.

"Si: 0.005% to 1.000%"

Si is an element that is contained to secure hardenability. When the Si content of the base material is less than 0.005%, the above-described effect cannot be obtained. Therefore, the Si content of the base material is preferably set to 0.005% or more. More preferably, 0.100% or more of Si is preferably contained. In a case where Cu is contained, the Si content is preferably 0.350% or more in order to suppress the hot embrittlement of Cu. On the other hand, when the Si content in steel exceeds 1.000%, the austenite transformation temperature ($Ac_3$ or the like) becomes extremely high, and there is a case where the cost necessary for heating for hot stamping increases or ferrite remains during the heating for hot stamping to decrease the strength of the hot stamping member. Therefore, the Si content of the base material is preferably set to 1.000% or less. The Si content of the base material is preferably 0.800% or less. In a case where Cu is contained, since the temperature of the austenite transformation temperature becomes high, the Si content of the base material is preferably 0.600% or less. The Si content may be 0.400% or less or 0.250% or less.

"Mn: 0.15% to 3.00%"

Mn is an element that contributes to hardenability. When the Mn content of the base material is less than 0.15%, the hardenability is low, and the tensile strength of the hot stamping member decreases. Therefore, the Mn content of the base material is preferably set to 0.15% or more. The Mn content of the base material is preferably 0.80% or more. On the other hand, when the Mn content of the base material is set to more than 3.00%, since a coarse inclusion is formed in steel, and brittle fracture is likely to occur, the Mn content of the base material is preferably set to 3.00% or less. The Mn content of the base material is preferably 2.00% or less.

"sol. Al: 0.00020% to 0.50000%"

Al is an element having an action of deoxidizing molten steel to improve the quality of the steel (suppressing the generation of a defect such as a blowhole in steel). When the sol. Al content of the base material is less than 0.00020%, since molten steel is not sufficiently deoxidized, and the above-described effect cannot be obtained, the sol. Al content of the base material is preferably set to 0.00020% or more. The sol. Al content of the base material is preferably 0.00100% or more or 0.00200% or more. On the other hand, when the sol. Al content of the base material exceeds 0.50000%, a coarse oxide is formed in steel, and the tensile strength or the like decreases. Therefore, the sol. Al content of the base material is preferably set to 0.50000% or less. The sol. Al content of the base material is preferably 0.40000% or less or 0.30000% or less. sol. Al in the base material means acid-soluble Al and refers to the total amount of the solid solution of Al that is present in steel in a solid solution state and Al that is present in steel as an acid-soluble precipitate such as AlN.

"P: 0.100% or Less"

P is an element that is segregated in grain boundaries and degrades the strength of the grain boundaries. When the P content of the base material exceeds 0.100%, the strength of grain boundaries significantly decreases, and the strength of the hot stamping member decreases. Therefore, the P content of the base material is preferably set to 0.100% or less. The P content of the base material is preferably 0.050% or less. A more preferable P content of the base material is 0.010% or less. The lower limit of the P content of the base material is not particularly limited; however, when the lower limit is decreased to lower than 0.0005%, the dephosphorization cost increases significantly, which is not preferable economically, and thus the lower limit of the P content of the base material may be set to 0.0005% in actual operation.

"S: 0.1000% or Less"

S is an element that forms an inclusion in steel. When the S content of the base material exceeds 0.1000%, a large amount of an inclusion is generated in steel, and the strength of the hot stamping member decreases. Therefore, the S content of the base material is preferably set to 0.1000% or less. The S content of the base material is preferably 0.0050% or less. The lower limit of the S content of the base material is not particularly limited; however, when the lower limit is decreased to lower than 0.00015%, the desulfurization cost increases significantly, which is not preferable economically, and thus the lower limit of the S content of the base material may be set to 0.00015% in actual operation.

"N: 0.0100% or Less"

N is an impurity element and an element that forms a nitride in steel to degrade the toughness and tensile strength of the hot stamping member. When the N content of the base material exceeds 0.0100%, a coarse nitride is formed in steel, and the strength of the hot stamping member significantly decreases. Therefore, the N content of the base material is preferably set to 0.0100% or less. The N content of the base material is preferably 0.0050% or less. The lower limit of the N content of the base material is not particularly limited; however, when the lower limit is decreased to lower than 0.0001%, the denitrification cost increases significantly, which is not preferable economically, and thus the lower limit of the N content of the base material may be set to 0.0001% in actual operation.

The base material of the hot stamping member according to the present embodiment may contain, instead of some of Fe, one or two or more selected from the group consisting of Cu, Ni, Nb, V, Ti, Mo, Cr, B, Ca and REM as an arbitrary element. In a case where the following arbitrary element is not contained, the content thereof is 0%.

"Cu: 0% to 1.00%"

Cu has an action of diffusing up to a plating layer of a hot stamping member during hot stamping to reduce hydrogen that intrudes during heating in the manufacturing of the hot stamping member. Therefore, Cu may be contained as necessary. In addition, Cu is an effective element for enhancing the hardenability of steel to stably secure the strength of the quenched hot stamping member. In a case where Cu is contained, the Cu content is preferably set to 0.005% or more in order to reliably exhibit the above-described effect. The Cu content is more preferably 0.150% or more. On the other hand, even when more than 1.00% of Cu is contained, the above-described effect is saturated, and thus the Cu content is preferably set to 1.00% or less. The Cu content is more preferably 0.350% or less.

"Ni: 0% to 1.00%"

Ni is an important element to suppress hot embrittlement caused by Cu during the manufacturing of the steel sheet and secure stable production, and thus Ni may be contained. When the Ni content is less than 0.005%, there is a case where the above-described effects cannot be sufficiently obtained. Therefore, the Ni content is preferably 0.005% or more. The Ni content is preferably 0.05% or more. On the other hand, when the Ni content exceeds 1.00%, the limit hydrogen amount of the steel sheet for hot stamping decreases. Therefore, the Ni content is set to 1.00% or less. The Ni content is preferably 0.60% or less.

"Nb: 0% to 0.150%"

Nb is an element that forms a carbide to contribute to improvement in the tensile strength of the hot stamping member. Therefore, Nb may be contained as necessary. In a case where Nb is contained, the Nb content of the base material is preferably set to 0.010% or more in order to reliably exhibit the above-described effect. The Nb content is more preferably 0.030% or more. On the other hand, even when more than 0.150% of Nb is contained, the above-described effect is saturated, and thus the Nb content of the base material is preferably set to 0.150% or less. The Nb content of the base material is more preferably 0.100% or less.

"V: 0% to 1.000%"

V is an element that forms a fine carbide and improves the limit hydrogen amount of steel by a refining effect or hydrogen trapping effect thereof. Therefore, V may be contained. In order to obtain the above-described effects, 0.005% or more of V is preferably contained, and 0.050% or more of V is more preferably contained. However, when the V content exceeds 1.000%, the above-described effects are saturated, and the economic efficiency decreases. Therefore, in the case of being contained, the V content is set to 1.000% or less.

"Ti: 0% to 0.150%"

Ti is an element that forms a carbide to contribute to improvement in the tensile strength of the hot stamping member. Therefore, Nb may be contained as necessary. In a case where Ti is contained, the Ti content of the base material is preferably set to 0.010% or more in order to reliably exhibit the above-described effect. The Ti content of the base material is preferably 0.020% or more. On the other hand, even when more than 0.150% of Ti is contained, the above-described effect is saturated, and thus the Ti content of the base material is preferably set to 0.150% or less. The Ti content of the base material is more preferably 0.120% or less.

"Mo: 0% to 1.000%"

Mo is an element that contributes to improvement in the strength of the hot stamping member by solid solution strengthening and thus may be contained as necessary. In a case where Mo is contained, the Mo content of the base material is preferably set to 0.005% or more in order to reliably exhibit the above-described effect. The Mo content of the base material is more preferably 0.010% or more. On the other hand, even when more than 1.000% of Mo is contained, the above-described effect is saturated, and thus the Mo content of the base material is preferably set to 1.000% or less. The Mo content of the base material is more preferably 0.800% or less.

"Cr: 0% to 1.000%"

Cr is an element that contributes to improvement in the strength of the hot stamping member by solid solution strengthening and thus may be contained as necessary. In a case where Cr is contained, the Cr content of the base material is preferably set to 0.050% or more in order to reliably exhibit the above-described effect. The Cr content of the base material is more preferably 0.100% or more. On the other hand, even when more than 1.000% of Cr is contained, the above-described effect is saturated, and thus the Cr content of the base material is preferably set to 1.000% or less. The Cr content of the base material is more preferably 0.800% or less.

"B: 0% to 0.0100%"

B is an element that is segregated in grain boundaries to improve the strength of the grain boundaries and thus may be contained as necessary. In a case where B is contained, the B content of the base material is preferably set to 0.0005% or more in order to reliably exhibit the above-described effect. The B content of the base material is preferably 0.0010% or more. On the other hand, even when more than 0.0100% of B is contained, the above-described effect is saturated, and thus the B content of the base material is preferably set to 0.0100% or less. The B content of the base material is more preferably 0.0075% or less.

"Ca: 0% to 0.010%"

Ca is an element having an action of deoxidizing molten steel to improve the quality of the steel. In order to reliably exhibit this action, the Ca content of the base material is preferably set to 0.001% or more. On the other hand, even when more than 0.010% of Ca is contained, the above-described effect is saturated, and thus the Ca content of the base material is preferably set to 0.010% or less.

"REM: 0% to 0.300%"

REM is an element having an action of deoxidizing molten steel to improve the quality of the steel. In order to reliably exhibit this action, the REM content of the base material is preferably set to 0.001% or more. On the other hand, even when more than 0.300% of REM is contained, the above-described effect is saturated, and thus the REM content of the base material is preferably set to 0.300% or less.

In the present embodiment, REM refers to a total of 17 elements consisting of Sc, Y, and lanthanoids, and the REM content refers to the total amount of these elements.

"Remainder Being Fe and Impurity"

The remainder of the chemical composition of the base material that configures the hot stamping member according to the present embodiment is Fe and an impurity. As the impurity, exemplified is an element that is incorporated from a steel raw material or a scrap and/or in a steelmaking process or intentionally added and is permitted to an extent that the properties of the hot stamping member according to the present embodiment are not impaired.

The above-described chemical composition of the base material may be measured by an ordinary analytical method. For example, the chemical composition may be measured using inductively coupled plasma-atomic emission spectrometry (ICP-AES). C and S may be measured using an infrared absorption method after combustion, and N may be measured using an inert gas melting-thermal conductivity method. The chemical composition needs to be analyzed after the plating layer on the surface is removed by machining. sol. Al may be measured by ICP-AES using a filtrate obtained by hydrolyzing a specimen with an acid.

(Thickness of Hot Stamping Member)

The thickness (sheet thickness) of the hot stamping member is not particularly limited and is preferably, for example, 0.4 mm or more. The thickness of the hot stamping member is more preferably 0.8 mm or more, 1.0 mm or more or 1.2 mm or more. The thickness of the hot stamping member is preferably 6.0 mm or less. The thickness of the hot stamping member is more preferably 5.0 mm or less, 4.0 mm or less, 3.2 mm or less or 2.8 mm or less.

(Tensile Strength)

The tensile strength of the hot stamping member may be set to 1600 MPa or more. As necessary, the lower limit of the tensile strength may be set to 1650 MPa, 1700 MPa, 1750 MPa or 1800 MPa, and the upper limit may be set to 2500 MPa, 2400 MPa, 2300 MPa or 2220 MPa. The tensile strength of the hot stamping member can be measured by the testing method described in JIS Z 2241: 2011 after a No. 5 test piece described in JIS Z 2241: 2011 was produced from an arbitrary position in the hot-stamping formed body.

<Manufacturing Method of Hot Stamping Member>

Next, a preferable manufacturing method of the hot stamping member will be described, but the manufacturing method of the hot stamping member is not limited to the following method. The hot stamping member can be manufactured by hot-stamping a steel sheet for hot stamping. Hereinafter, the steel sheet for hot stamping will be described.

(Steel Sheet for Hot Stamping)

The steel sheet for hot stamping includes a steel sheet, an Al—Si alloy plating layer and a Ni plating layer. The configuration of the plating layer of the hot stamping member according to the present embodiment can be obtained by the diffusion of each component in the steel sheet, the Al—Si alloy plating layer and the Ni plating layer during hot stamping. Hereinafter, each configuration will be described.

"Steel Sheet"

The chemical composition of the steel sheet (base material) that serves as the substrate of the steel sheet for hot stamping according to the present embodiment may be, for example, by mass %, C: 0.01% or more and less than 0.70%, Si: 0.005% to 1.000%, Mn: 0.15% to 3.00%, sol. Al:

0.0002% to 0.5000%, P: 0.100% or less, S: 0.1000% or less, N: 0.0100% or less, Cu: 0% to 1.00%, Ni: 0% to 1.00%, Nb: 0% to 0.150%, V: 0% to 1.000%, Ti: 0% to 0.150%, Mo: 0% to 1.000%, Cr: 0% to 1.000%, B: 0% to 0.0100%, Ca: 0% to 0.010%, REM: 0% to 0.300%, and a remainder: Fe and an impurity.

"Metallographic Structure of Steel Sheet"

In the metallographic structure of the steel sheet (base material) that serves as the substrate of the steel sheet for hot stamping, the area ratio of ferrite may be 20% or more in terms of the area ratio in a cross section. A more preferable area ratio of ferrite is 30% or more. Ferrite may be 80% or less in terms of the area ratio in a cross section. A more preferable area ratio of ferrite is 70% or less. The area ratio of pearlite may be 20% or more in terms of the area ratio in a cross section. A more preferable area ratio of pearlite is 30% or more. The area ratio of pearlite may be 80% or less. A more preferable area ratio of pearlite is 70% or less. In the area ratio of the cross section, the remainder may be bainite, martensite or residual austenite. The area ratio of the remainder may be less than 5%.

The thickness of the steel sheet (base material) is, for example, 0.4 mm or more. A more preferable thickness of the steel sheet (base material) is 0.8 mm or more, 1.0 mm or more or 1.2 mm or more. The thickness of the steel sheet (base material) is preferably 6.0 mm or less. A more preferable thickness of the steel sheet (base material) is 5.0 mm or less, 4.0 mm or less, 3.2 mm or less or 2.8 mm or less.

"Al—Si Alloy Plating Layer"

The A—Si alloy plating layer of the steel sheet for hot stamping is provided as an upper layer of the steel sheet (base material). The Al—Si alloy plating layer is plating containing Al and Si as main components. Here, the expression "containing Al and Si as main component" means that at least the Al content is 75 mass % or more, the Si content is 3 mass % or more and the total of the Al content and the Si content is 95 mass % or more. The Al content in the Al—Si alloy plating layer is preferably 80 mass % or more. The Al content in the Al—Si alloy plating layer is preferably 95 mass % or less.

The Si content in the Al—Si alloy plating layer is 3 mass % or more. The Si content in the Al—Si alloy plating layer is more preferably 6 mass % or more. The Si content in the Al—Si alloy plating layer is 20 mass % or less. The Si content is more preferably 12 mass % or less. When the Si content in the Al—Si alloy plating layer is 3 mass % or more, it is possible to suppress the alloying of Fe and Al and to suppress the diffusion of Al. When the Si content in the Al—Si alloy plating layer is 20 mass % or less during hot stamping, it is possible to sufficiently suppress the diffusion of Fe. The total of the Al content and the Si content may be 97 mass % or more, 98 mass % or more or 99 mass % or more. The remainder in the Al—Si alloy plating layer is Fe and an impurity. As the impurity, a component that is incorporated during the manufacturing of the Al—Si alloy plating layer, a component in the steel sheet (base material) or the like is an exemplary example.

The average thickness of the Al—Si alloy plating layer of the steel sheet for hot stamping according to the present embodiment is 7 μm or more. This is because, when the average thickness of the Al—Si alloy plating layer is less than 7 μm, there is a case where it is not possible to sufficiently suppress the formation of a scale during hot stamping. A more preferable average thickness of the Al—Si alloy plating layer is 12 μm or more, 15 μm or more, 18 μm or more or 22 μm or more. Regarding the upper limit, the average thickness of the Al—Si alloy plating layer may be 148 μm or less. This is because, when the average thickness of the Al—Si alloy plating layer is more than 148 μm, not only is the above-described effect saturated, but the cost also increases. A more preferable average thickness of the Al—Si alloy plating layer is 100 μm or less, 60 μm or less, 45 μm or less or 37 μm or less.

"Ni Plating Layer"

The Ni plating layer of the steel sheet for hot stamping is provided as an upper layer of the Al—Si alloy plating layer. When the average thickness of the Ni plating layer is 200 nm or less, there is a case where the diffusion of the Fe content cannot be sufficiently suppressed in the region from 100 nm in the thickness direction from the surface of the plating layer to the 1000 nm position in the thickness direction from the surface of the plating layer of the hot stamping member. Therefore, the average thickness of the Ni plating layer is more than 200 nm. A more preferable average thickness of the Ni plating layer is 280 nm or more, 350 nm or more, 450 nm or more, 560 nm or more or 650 nm or more. When the average thickness of the Ni plating layer is more than 2500 nm, since the cost becomes high, the average thickness of the Ni plating layer may be 2500 nm or less. A more preferable average thickness of the Ni plating layer is 1500 nm or less, 1200 nm or less or 1000 nm or less.

When the Ni content of the Ni plating layer is 90 mass % or less, it is not possible to sufficiently suppress the diffusion of Fe in the region from 100 nm in the thickness direction from the surface of the plating layer to the 1000 nm position in the thickness direction from the surface of the plating layer of the hot stamping member. Therefore, the Ni content in the Ni plating layer is more than 90 mass %. A more preferable Ni content is 92 mass % or more or 94 mass %. A more preferable Ni content is 96 mass % or more, 98 mass % or more or 99 mass % or more. A still more preferable Ni content is 94 mass % or more. The chemical composition of the remainder of the Ni plating layer (excluding Ni) is not particularly limited. Cr may be contained in the Ni plating layer, and the Ni/Cr ratio is preferably larger than 9, and this ratio is more preferably 15 or more or 30 or more. The Cr content in the Ni plating layer is preferably 6.0 mass % or less and more preferably 4.0 mass % or less or 3.0 mass % or less. The Cr content of the Ni plating layer is still more preferably 2.0 mass % or less. When the Cr content is reduced, it is possible to improve the corrosion resistance.

(Manufacturing Method of Steel Sheet for Hot Stamping)

A manufacturing method of the steel sheet for hot stamping will be described, but a manufacturing method of a steel sheet for hot stamping that is used for the hot stamping member according to the present embodiment is not limited to the following method.

A slab having the above-described chemical composition is hot-rolled, cooled and coiled, thereby obtaining a steel sheet (base material) that serves as the substrate of the steel sheet for hot stamping. A slab that is to be subjected to hot rolling may be a slab manufactured by a normal method and may be, for example, a slab manufactured by an ordinary method such as a continuous cast slab or a thin slab caster. Hot rolling and cooling and coiling after the hot rolling may also be carried out by an ordinary method and are not particularly limited.

After the coiling, cold rolling may be further carried out as necessary. The cumulative rolling reduction in the cold rolling is not particularly limited, but is preferably set to 40% to 60% from the viewpoint of the shape stability of the steel sheet (base material).

"Al—Si Alloy Plating"

Al—Si alloy plating is provided on the hot-rolled steel sheet as it is or after cold rolling, thereby forming an Al—Si alloy plating layer. A method for forming the Al—Si alloy plating layer is not particularly limited, and a hot-dip plating method, an electro plating method, a vacuum deposition method, a cladding method, a thermal spraying method or the like can be used. The hot-dip plating method is particularly preferable.

In a case where the Al—Si alloy plating layer is formed by the hot-dip plating method, the steel sheet (base material) is immersed in a plating bath where the components have been adjusted such that at least the Si content reaches 3 mass % or more and the total of the Al content and the Si content reaches 95 mass % or more, thereby obtaining the Al—Si alloy-plated steel sheet. The temperature of the plating bath is preferably within a temperature range of 660° C. to 690° C. Before the Al—Si alloy plating layer is provided, plating may be carried out after the steel sheet (base material) is heated up to near 650° C. to 780° C. The average thickness of the Al—Si alloy plating layer is adjusted with the immersion time in the plating bath and by wiping.

In addition, in a case where hot-dip plating is carried out, there is a case where Fe is incorporated into the plating bath as an impurity other than Al or Si. In addition, Ni, Mg, Ti, Zn, Sb, Sn, Cu, Co, In, Bi, Ca, mischmetal, and the like may be further contained in the plating bath as long as the Si content reaches 3 mass % or more and the total of the Al content and the Si content reaches 95 mass % or more.

"Ni Plating"

The steel sheet for hot stamping is obtained by forming a Ni plating layer after the formation of the Al—Si alloy plating layer. The Ni plating layer may be formed by an electro plating method, a vacuum deposition method or the like. In a case where the Ni plating layer is formed by electro plating, the steel sheet on which the Al—Si alloy plating layer has been formed is immersed in a plating bath containing nickel sulfate, nickel chloride and boric acid and the current density and the energization time are controlled as appropriate using soluble Ni as an anode, whereby the Ni plating layer can be formed such that the average thickness reaches more than 200 nm and 2500 nm or less. After the Ni plating, temper rolling may be carried out at a cumulative rolling reduction of approximately 0.5% to 2% (particularly, in a case where the plating original sheet is a cold-rolled steel sheet).

<Hot Stamping Step>

A hot stamping member is obtained by hot-stamping the steel sheet for hot stamping manufactured above. Hereinafter, conditions for the hot stamping will be described as an example, but the hot stamping conditions are not limited to these conditions.

The steel sheet for hot stamping is put into a heating furnace and heated up to a temperature of the $Ac_3$ point or higher (target temperature) at a heating speed of 2.0° C./second to 10.0° C./second. When the heating temperature is 2.0° C./second to 10.0° C./second, it is possible to prevent the surface diffusion of Fe. When the target temperature is the $Ac_3$ point or higher, it is possible to suppress spring back, which is preferable. The $Ac_3$ point (° C.) is represented by the following formula (1).

$$Ac_3=912-230.5\times C+31.6\times Si-20.4\times Mn-14.8\times Cr-18.1\times Ni+16.8\times Mo-39.8\times Cu \quad (1)$$

Element symbols in the formula indicate the amounts by mass % of the corresponding elements, and zero is assigned in a case where an element is not contained.

The retention time after the target temperature is reached is preferably set to 5 seconds or longer and 300 seconds or shorter. When the retention time is 5 seconds or longer and 300 seconds or shorter, it is possible to suppress the diffusion of Fe into the hot-stamped surface, which is preferable.

The steel sheet after the retention is hot-stamped and cooled down to room temperature to obtain a hot stamping member. The cooling rate up to room temperature after the hot stamping (after forming) is preferably 5° C./second or faster. When the cooling rate is 5° C./second or faster, it is possible to suppress the diffusion of Fe into the outermost surface of the hot stamping member.

The holding time in a temperature range of 450° C. or higher (a time during which the steel sheet resides at 450° C. or higher while being heated, retained and cooled) is 7.0 minutes or shorter. The holding time is more preferably 3.5 minutes or shorter and still more preferably 2.1 minutes or shorter. In a case where the holding time in the temperature range of 450° C. or higher is longer than 7.0 minutes, there is a case where Fe diffuses up to the outermost surface of the hot stamping member.

In addition, the steel sheet may be tempered after the hot stamping as necessary. For example, the steel sheet may be retained at 250° C. for 30 minutes.

When the steel sheet for hot stamping manufactured by the above-described manufacturing method is hot-stamped under the above-described conditions in an environment including the atmosphere or the like, it is possible to react Ni near the surface layer of the hot stamping member with oxygen, moisture and the like in the atmosphere in the region from the surface of the plating layer to the 20 nm position (in the thickness direction from the plating layer), to form at least one of a Ni oxide and a Ni hydroxide near the surface layer of the plating layer of the hot stamping member and to set the Ni content near the surface layer of the plating layer of the hot stamping member to 30 mass % or more.

EXAMPLES

Next, examples of the present invention will be described. Conditions in the examples are examples of conditions adopted to confirm the feasibility and effect of the present invention, and the present invention is not limited to the examples of conditions. The present invention is capable of adopting a variety of conditions as long as the objective of the present invention is achieved without departing from the gist of the present invention.

(Manufacturing of Steel Sheet)

Slabs manufactured by casting molten steel having a chemical composition shown in Tables 1A and 1B were hot-rolled by being heated up to a temperature range of the $Ac_3$ to 1400° C., cooled under cooling conditions shown in Tables 2A, 2B, 2C and 2D and coiled at coiling start temperature shown in Tables 2A, 2B, 2C and 2D, thereby obtaining hot-rolled steel sheets (steel sheets). In steel sheets No. 91 to No. 102, the slabs were cold-rolled to a thickness of 1.6 mm from 3.2 mm after the hot rolling, thereby obtaining cold-rolled steel sheets. The other steel sheets were rolled to a thickness of 1.6 mm by hot rolling.

TABLE 1A

| Steel No. | Chemical composition (mass %), remainder: Fe and impurity | | | | | | | | | | |
|---|---|---|---|---|---|---|---|---|---|---|---|
| | C | Si | Mn | P | S | sol. Al | N | Cu | Ni | Nb | V |
| 1 | 0.23 | 0.254 | 1.21 | 0.010 | 0.0009 | 0.03200 | 0.0039 | | | 0.012 | |
| 2 | 0.01 | 0.112 | 0.42 | 0.010 | 0.0061 | 0.03110 | 0.0036 | | | | |
| 3 | 0.08 | 0.201 | 1.56 | 0.009 | 0.0012 | 0.02960 | 0.0030 | | | | |
| 4 | 0.21 | 0.197 | 1.18 | 0.007 | 0.0006 | 0.01278 | 0.0026 | | | | |
| 5 | 0.25 | 0.194 | 1.27 | 0.006 | 00044 | 0.03891 | 0.0034 | | | | |
| 6 | 0.31 | 0.197 | 1.67 | 0.007 | 0.0041 | 0.03808 | 0.0025 | | | | |
| 7 | 0.35 | 0.198 | 1.42 | 0.007 | 0.0004 | 0.02470 | 0.0045 | | | | |
| 8 | 0.45 | 0.216 | 1.73 | 0.008 | 0,0030 | 0.03330 | 0.0025 | | | | |
| 9 | 0.65 | 0.230 | 1.32 | 0.009 | 0.0034 | 0.01829 | 0.0022 | | | | |
| 10 | 0.29 | 0.176 | 1.67 | 0.006 | 0.0030 | 0.04945 | 0.0032 | | | | |
| 11 | 0.31 | 0.130 | 1.98 | 0.006 | 0.0022 | 0.02795 | 0.0032 | | | | |
| 12 | 0.36 | 0.189 | 1.88 | 0.008 | 0.0016 | 0.04619 | 0.0024 | | | | |
| 13 | 0.04 | 0.016 | 0.16 | 0.007 | 0.0045 | 0.04841 | 0.0017 | | | | |
| 14 | 0.45 | 0.201 | 0.42 | 0.005 | 0.0041 | 0.01086 | 0.0037 | | | | |
| 15 | 0.36 | 0.223 | 0.78 | 0.010 | 0.0007 | 0.02867 | 0.0044 | | | | |
| 16 | 0.32 | 0.190 | 1.31 | 0.006 | 0.0022 | 0.04411 | 0.0050 | | | | |
| 17 | 0.30 | 0.216 | 1.76 | 0.010 | 0.0012 | 0.02610 | 0.0015 | | | | |
| 18 | 0.35 | 0.191 | 2.41 | 0.006 | 0.0048 | 0.02509 | 0.0040 | | | | |
| 19 | 0.28 | 0.201 | 2.88 | 0.007 | 0.0025 | 0.03602 | 0.0038 | | | | |
| 20 | 0.29 | 0.212 | 0.90 | 0.005 | 0.0040 | 0.04864 | 0.0043 | | | | |
| 21 | 0.30 | 0.218 | 1.65 | 0.095 | 0.0009 | 0.01105 | 0.0047 | | | | |
| 22 | 0.31 | 0.199 | 1.89 | 0.005 | 0.0003 | 0.03334 | 0.0019 | | | | |
| 23 | 0.35 | 0.229 | 1.13 | 0.005 | 0.0036 | 0.01883 | 0.0027 | | | | |

| Steel No. | Chemical composition (mass %), remainder: Fe and impurity | | | | | | Ac3 point (° C.) | Note |
|---|---|---|---|---|---|---|---|---|
| | Ti | Mo | Cr | B | Ca | REM | | |
| 1 | 0.026 | 0.002 | 0.211 | 0,0020 | | | 839 | Present Invention Steel |
| 2 | | | | | | | 905 | Present Invention Steel |
| 3 | | | | | | | 868 | Present Invention Steel |
| 4 | | | | | | | 846 | Present Invention Steel |
| 5 | | | | | | | 835 | Present Invention Steel |
| 6 | | | | | | | 813 | Present Invention Steel |
| 7 | | | | | | | 809 | Present Invention Steel |
| 8 | | | | | | | 780 | Present Invention Steel |
| 9 | | | | | | | 743 | Present Invention Steel |
| 10 | | | | | | | 817 | Present Invention Steel |
| 11 | | | | | | | 804 | Present Invention Steel |
| 12 | | | | | | | 797 | Present Invention Steel |
| 13 | | | | | | | 900 | Present Invention Steel |
| 14 | | | | | | | 806 | Present Invention Steel |
| 15 | | | | | | | 820 | Present Invention Steel |
| 16 | | | | | | | 818 | Present Invention Steel |
| 17 | | | | | | | 814 | Present Invention Steel |
| 18 | | | | | | | 788 | Present Invention Steel |
| 19 | | | | | | | 795 | Present Invention Steel |
| 20 | | | | | | | 833 | Present Invention Steel |
| 21 | | | | | | | 816 | Present Invention Steel |
| 22 | | | | | | | 808 | Present Invention Steel |
| 23 | | | | | | | 816 | Present Invention Steel |

TABLE 1B

| Steel No. | Chemical composition (mass %), remainder: Fe and impurity | | | | | | | | | | |
|---|---|---|---|---|---|---|---|---|---|---|---|
| | C | Si | Mn | P | S | sol. Al | N | Cu | Ni | Nb | V |
| 24 | 0.35 | 0.220 | 1.51 | 0.009 | 0.0946 | 0.01462 | 0.0043 | | | | |
| 25 | 0.28 | 0.216 | 1.14 | 0.005 | 0.0008 | 0.00030 | 0.0031 | | | | |
| 26 | 0.30 | 0.209 | 1.38 | 0.007 | 0.0041 | 0.03100 | 0.0024 | | | | |
| 27 | 0.29 | 0.226 | 1.66 | 0.010 | 0.0048 | 0.46100 | 0.0024 | | | | |
| 28 | 0.31 | 0.221 | 1.24 | 0.009 | 0.0010 | 0.03734 | 0.0078 | | | | |
| 29 | 0.35 | 0.212 | 0.83 | 0.010 | 0.0002 | 0.03058 | 0.0091 | | | | |
| 30 | 0.36 | 0.219 | 0.97 | 0.005 | 0.0018 | 0.02210 | 0.0021 | | | 0.012 | |
| 31 | 0.29 | 0.213 | 1.98 | 0.010 | 0.0046 | 0.01365 | 0.0024 | | | 0.038 | |
| 32 | 0.31 | 0.214 | 1.28 | 0.009 | 0.0012 | 0.03927 | 0.0047 | | | 0.078 | |
| 33 | 0.08 | 0.193 | 1.56 | 0.008 | 0.0046 | 0.02263 | 0.0018 | | | 0.142 | |
| 34 | 0.36 | 0.224 | 1.74 | 0.009 | 0.0004 | 0.02299 | 0.0040 | | | | |
| 35 | 0.32 | 0.200 | 1.09 | 0.007 | 0.0011 | 0.03013 | 0.0027 | | | | |
| 36 | 0.35 | 0.194 | 0.93 | 0.009 | 0.0014 | 0.01834 | 0.0029 | | | | |
| 37 | 0.33 | 0.223 | 1.36 | 0.010 | 0.0007 | 0.01077 | 0.0026 | | | | |
| 38 | 0.33 | 0.194 | 1.11 | 0.006 | 0.0033 | 0.03567 | 0.0021 | | | | |
| 39 | 0.32 | 0.192 | 1.53 | 0.006 | 0.0023 | 0.01660 | 0.0034 | | | | |
| 40 | 0.36 | 0.196 | 1.85 | 0.010 | 0.0050 | 0.01301 | 0.0031 | | | | |
| 41 | 0.36 | 0.200 | 1.93 | 0.005 | 0.0016 | 0.03784 | 0.0016 | | | | |
| 42 | 0.31 | 0.191 | 1.64 | 0.008 | 0.0007 | 0.01268 | 0.0019 | | | | |
| 43 | 0.36 | 0.204 | 1.79 | 0.009 | 0.0037 | 0.04722 | 0.0041 | | | | |
| 44 | 0.31 | 0.206 | 1.31 | 0.005 | 0.0050 | 0.03133 | 0.0023 | | | | |
| 45 | 0.32 | 0.230 | 1.81 | 0.007 | 0.0026 | 0.01163 | 0.0037 | | | | |
| 46 | 0.33 | 0.205 | 1.59 | 0.006 | 0.0019 | 0.03027 | 0.0024 | | | | |
| 47 | 0.33 | 0.218 | 1.37 | 0.010 | 0.0021 | 0.04957 | 0.0018 | | | | |
| 48 | 0.27 | 0.600 | 0.85 | 0.010 | 0.0020 | 0.01200 | 0.0050 | 0.26 | 0.13 | 0.050 | |
| 49 | 0.55 | 0.280 | 0.41 | 0.005 | 0.0004 | 0.01100 | 0.0030 | 0.30 | 0.10 | 0.030 | |
| 50 | 0.30 | 0.470 | 0.65 | 0.010 | 0.0017 | 0.01300 | 0.0040 | 0.18 | 0.09 | 0.040 | |
| 51 | 0.42 | 0.370 | 0.56 | 0.010 | 0.0014 | 0.01100 | 0.0040 | 0.90 | 0.18 | 0.050 | 0.150 |
| 52 | 0.22 | 0.196 | 1.19 | 0.007 | 0.0006 | 0.01272 | 0.0025 | 0.16 | 0.08 | | |
| 53 | 0.21 | 0.197 | 1.18 | 0.006 | 0.0006 | 0.01274 | 0.0026 | 0.01 | | | |
| 54 | 0.21 | 0.195 | 1.20 | 0.007 | 0.0005 | 0.01278 | 0.0022 | | 0.01 | | |
| 55 | 0.20 | 0.199 | 1.17 | 0.008 | 0.0004 | 0.01275 | 0.0026 | | | | 0.090 |

| Steel No. | Chemical composition (mass %), remainder: Fe and impurity | | | | | | Ac3 point (° C.) | Note |
|---|---|---|---|---|---|---|---|---|
| | Ti | Mo | Cr | B | Ca | REM | | |
| 24 | | | | | | | 807 | Present Invention Steel |
| 25 | | | | | | | 831 | Present Invention Steel |
| 26 | | | | | | | 821 | Present Invention Steel |
| 27 | | | | | | | 818 | Present Invention Steel |
| 28 | | | | | | | 822 | Present Invention Steel |
| 29 | | | | | | | 821 | Present Invention Steel |
| 30 | | | | | | | 816 | Present Invention Steel |
| 31 | | | | | | | 811 | Present Invention Steel |
| 32 | | | | | | | 821 | Present Invention Steel |
| 33 | | | | | | | 868 | Present Invention Steel |
| 34 | 0.011 | | | | | | 801 | Present Invention Steel |
| 35 | 0.026 | | | | | | 822 | Present Invention Steel |
| 36 | 0.141 | | | | | | 818 | Present Invention Steel |
| 37 | | 0.005 | | | | | 815 | Present Invention Steel |
| 38 | | 0.010 | | | | | 820 | Present Invention Steel |
| 39 | | 0.984 | | | | | 830 | Present Invention Steel |
| 40 | | | 0.012 | | | | 797 | Present Invention Steel |
| 41 | | | 0.208 | | | | 793 | Present Invention Steel |
| 42 | | | 0.989 | | | | 798 | Present Invention Steel |

TABLE 1B-continued

| | | | | | | | |
|---|---|---|---|---|---|---|---|
| 43 | | | 0.0005 | | | 799 | Present Invention Steel |
| 44 | | | 0.0021 | | | 820 | Present Invention Steel |
| 45 | | | 0.0088 | | | 809 | Present Invention Steel |
| 46 | | | | 0.009 | | 810 | Present Invention Steel |
| 47 | | | | | 0.270 | 815 | Present Invention Steel |
| 48 | 0.030 | 0.300 | 0.0020 | | | 844 | Present Invention Steel |
| 49 | 0.027 | 0.200 | 0.0023 | | | 777 | Present Invention Steel |
| 50 | 0.040 | 0.220 | 0.0022 | | | 839 | Present Invention Steel |
| 51 | 0.038 | 0.240 | 0.0021 | | | 780 | Present Invention Steel |
| 52 | | | | | | 835 | Present Invention Steel |
| 53 | | | | | | 845 | Present Invention Steel |
| 54 | | | | | | 845 | Present Invention Steel |
| 55 | | | | | | 848 | Present Invention Steel |

TABLE 2A

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 1 | 1 | 981 | 57 | 647 | Hot-dip plating | 88 | 11 | 1.0 | 33.3 | Electro plating | 75 | 200 | Comparative Example |
| 2 | 2 | 980 | 57 | 628 | Hot-dip plating | 89 | 10.5 | 0.5 | 32.6 | Electro plating | 99 | 1011 | Present Invention Example |
| 3 | 3 | 985 | 58 | 618 | Hot-dip plating | 91 | 8.7 | 0.3 | 31.5 | Electro plating | 99 | 809 | Present Invention Example |
| 4 | 4 | 992 | 78 | 638 | Hot-dip plating | 89 | 10.8 | 0.2 | 32.2 | Electro plating | 98 | 1003 | Present Invention Example |
| 5 | 5 | 1041 | 53 | 603 | Hot-dip plating | 91 | 8.9 | 0.1 | 31.5 | Electro plating | 99 | 743 | Present Invention Example |
| 6 | 6 | 955 | 82 | 644 | Hot-dip plating | 92 | 7.1 | 0.9 | 24.4 | Electro plating | 99 | 573 | Present Invention Example |
| 7 | 7 | 992 | 91 | 617 | Hot-dip plating | 93 | 5.6 | 1.4 | 28.9 | Electro plating | 99 | 584 | Present Invention Example |
| 8 | 8 | 1000 | 79 | 646 | Hot-dip plating | 89 | 10.6 | 0.4 | 32.6 | Electro plating | 99 | 902 | Present Invention Example |
| 9 | 9 | 991 | 62 | 638 | Hot-dip plating | 92 | 7.1 | 0.9 | 25.2 | Electro plating | 99 | 677 | Present Invention Example |
| 10 | 10 | 989 | 86 | 646 | Hot-dip plating | 90 | 8.4 | 1.6 | 36.3 | Electro plating | 99 | 800 | Present Invention Example |
| 11 | 11 | 1020 | 72 | 620 | Hot-dip plating | 89 | 9.8 | 1.2 | 32.2 | Electro plating | 99 | 997 | Present Invention Example |
| 12 | 12 | 1000 | 50 | 631 | Hot-dip plating | 89 | 9.8 | 1.2 | 35.9 | Electro plating | 99 | 1086 | Present Invention Example |
| 13 | 13 | 1000 | 80 | 632 | Hot-dip plating | 89 | 9.9 | 1.1 | 33.0 | Electro plating | 99 | 764 | Present Invention Example |
| 14 | 14 | 1010 | 94 | 642 | Hot-dip plating | 92 | 7.7 | 0.3 | 32.2 | Electro plating | 99 | 1118 | Present Invention Example |
| 15 | 15 | 997 | 89 | 637 | Hot-dip plating | 91 | 7.3 | 1.7 | 27.8 | Electro plating | 99 | 699 | Present Invention Example |
| 16 | 16 | 1037 | 53 | 612 | Hot-dip plating | 91 | 8.8 | 0.2 | 35.9 | Electro plating | 99 | 998 | Present Invention Example |
| 17 | 17 | 1046 | 57 | 642 | Hot-dip plating | 91 | 7.5 | 1.5 | 24.8 | Electro plating | 98 | 686 | Present Invention Example |
| 18 | 18 | 996 | 82 | 622 | Hot-dip plating | 90 | 8.7 | 1.3 | 34.1 | Electro plating | 99 | 724 | Present Invention Example |
| 19 | 19 | 956 | 72 | 604 | Hot-dip plating | 93 | 5.7 | 1.3 | 27.8 | Electro plating | 99 | 551 | Present Invention Example |
| 20 | 20 | 1047 | 79 | 641 | Hot-dip plating | 93 | 5.7 | 1.3 | 29.3 | Electro plating | 98 | 595 | Present Invention Example |

TABLE 2A-continued

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 21 | 21 | 1045 | 90 | 609 | Hot-dip plating | 89 | 10.7 | 0.3 | 28.9 | Electro plating | 99 | 720 | Present Invention Example |
| 22 | 22 | 979 | 65 | 645 | Hot-dip plating | 92 | 7.4 | 0.6 | 27.0 | Electro plating | 98 | 653 | Present Invention Example |

Underlines indicate that the corresponding values are outside the scope of the present invention.

TABLE 2B

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 23 | 23 | 1044 | 51 | 646 | Hot-dip plating | 90 | 8.6 | 1.4 | 25.9 | Electro plating | 99 | 700 | Present Invention Example |
| 24 | 24 | 1016 | 94 | 650 | Hot-dip plating | 90 | 9.2 | 0.8 | 30.4 | Electro plating | 99 | 1012 | Present Invention Example |
| 25 | 25 | 974 | 54 | 627 | Hot-dip plating | 91 | 7.4 | 1.6 | 24.1 | Electro plating | 99 | 553 | Present Invention Example |
| 26 | 26 | 979 | 70 | 640 | Hot-dip plating | 92 | 6.5 | 1.5 | 34.4 | Electro plating | 99 | 539 | Present Invention Example |
| 27 | 27 | 955 | 89 | 631 | Hot-dip plating | 90 | 9.5 | 0.5 | 34.8 | Electro plating | 99 | 584 | Present Invention Example |
| 28 | 28 | 1009 | 71 | 620 | Hot-dip plating | 90 | 8.3 | 1.7 | 27.0 | Electro plating | 99 | 685 | Present Invention Example |
| 29 | 29 | 990 | 57 | 603 | Hot-dip plating | 89 | 10.9 | 0.1 | 23.3 | Electro plating | 99 | 888 | Present Invention Example |
| 30 | 30 | 1020 | 90 | 600 | Hot-dip plating | 90 | 9.3 | 0.7 | 33.3 | Electro plating | 99 | 894 | Present Invention Example |
| 31 | 31 | 995 | 62 | 642 | Hot-dip plating | 90 | 9.7 | 0.3 | 25.6 | Electro plating | 98 | 539 | Present Invention Example |
| 32 | 32 | 1005 | 80 | 619 | Hot-dip plating | 90 | 9.3 | 0.7 | 34.4 | Electro plating | 99 | 640 | Present Invention Example |
| 33 | 33 | 1018 | 69 | 645 | Hot-dip plating | 92 | 7.1 | 0.9 | 33.7 | Electro plating | 99 | 714 | Present Invention Example |
| 34 | 34 | 969 | 67 | 647 | Hot-dip plating | 91 | 8.3 | 0.7 | 36.3 | Electro plating | 99 | 607 | Present Invention Example |
| 35 | 35 | 1045 | 54 | 644 | Hot-dip plating | 92 | 6.7 | 1.3 | 33.0 | Electro plating | 99 | 758 | Present Invention Example |
| 36 | 36 | 1004 | 62 | 646 | Hot-dip plating | 89 | 9.8 | 1.2 | 26.7 | Electro plating | 99 | 1007 | Present Invention Example |
| 37 | 37 | 1023 | 82 | 616 | Hot-dip plating | 89 | 11.0 | 0.0 | 30.4 | Electro plating | 99 | 841 | Present Invention Example |
| 38 | 38 | 971 | 58 | 630 | Hot-dip plating | 91 | 8.1 | 0.9 | 33.0 | Electro plating | 99 | 666 | Present Invention Example |
| 39 | 39 | 1047 | 88 | 608 | Hot-dip plating | 90 | 8.0 | 2.0 | 24.1 | Electro plating | 99 | 591 | Present Invention Example |
| 40 | 40 | 1011 | 77 | 629 | Hot-dip plating | 93 | 5.6 | 1.4 | 28.9 | Electro plating | 99 | 560 | Present Invention Example |
| 41 | 41 | 976 | 77 | 647 | Hot-dip plating | 90 | 8.4 | 1.6 | 24.1 | Electro plating | 99 | 877 | Present Invention Example |
| 42 | 42 | 1033 | 97 | 645 | Hot-dip plating | 90 | 9.8 | 0.2 | 35.2 | Electro plating | 99 | 1088 | Present Invention Example |

TABLE 2B-continued

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 43 | 43 | 962 | 53 | 629 | Hot-dip plating | 92 | 7.4 | 0.6 | 36.3 | Electro plating | 99 | 760 | Present Invention Example |
| 44 | 44 | 977 | 67 | 601 | Hot-dip plating | 90 | 8.8 | 1.2 | 24.4 | Electro plating | 98 | 1086 | Present Invention Example |
| 45 | 45 | 969 | 52 | 624 | Hot-dip plating | 92 | 7.2 | 0.8 | 24.8 | Electro plating | 99 | 810 | Present Invention Example |

Underlines indicate that the corresponding values are outside the scope of the present invention.

TABLE 2C

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 46 | 46 | 1019 | 65 | 616 | Hot-dip plating | 89 | 10.7 | 0.3 | 37.0 | Electro plating | 99 | 983 | Present Invention Example |
| 47 | 47 | 1045 | 99 | 644 | Hot-dip plating | 89 | 9.8 | 1.2 | 28.9 | Electro plating | 98 | 840 | Present Invention Example |
| 48 | 4 | 831 | 80 | 606 | Hot-dip plating | 92 | 6.4 | 1.6 | 34.4 | Electro plating | 99 | 862 | Present Invention Example |
| 49 | 4 | 786 | 50 | 608 | Hot-dip plating | 91 | 8.8 | 0.2 | 33.0 | Electro plating | 99 | 609 | Present Invention Example |
| 50 | 4 | 1014 | 32 | 633 | Hot-dip plating | 92 | 8.0 | 0.0 | 31.9 | Electro plating | 99 | 1073 | Present Invention Example |
| 51 | 4 | 1030 | 25 | 646 | Hot-dip plating | 93 | 5.9 | 1.1 | 34.4 | Electro plating | 99 | 885 | Present Invention Example |
| 52 | 4 | 990 | 81 | 635 | Hot-dip plating | 89 | 9.8 | 1.2 | 28.5 | Electro plating | 97 | 539 | Present Invention Example |
| 53 | 4 | 980 | 54 | 792 | Hot-dip plating | 93 | 5.9 | 1.1 | 32.2 | Electro plating | 99 | 647 | Present Invention Example |
| 54 | 4 | 1008 | 87 | 644 | Hot-dip plating | 98 | 1.5 | 0.5 | 34.1 | Electro plating | 99 | 849 | Comparative Example |
| 55 | 4 | 1022 | 78 | 634 | Hot-dip plating | 96 | 3.4 | 1.5 | 36.3 | Electro plating | 99 | 652 | Present Invention Example |
| 56 | 4 | 1046 | 99 | 612 | Hot-dip plating | 93 | 6.2 | 0.8 | 25.6 | Electro plating | 99 | 880 | Present Invention Example |
| 57 | 4 | 1013 | 82 | 605 | Hot-dip plating | 90 | 9.7 | 0.3 | 35.9 | Electro plating | 99 | 1106 | Present Invention Example |
| 58 | 4 | 998 | 50 | 610 | Hot-dip plating | 88 | 11.3 | 0.7 | 30.7 | Electro plating | 97 | 551 | Present Invention Example |
| 59 | 4 | 998 | 51 | 643 | Hot-dip plating | 80 | 19.4 | 0.6 | 30.7 | Electro plating | 99 | 831 | Present Invention Example |
| 60 | 4 | 1038 | 74 | 644 | Hot-dip plating | 78 | 21.7 | 0.3 | 33.3 | Electro plating | 98 | 663 | Comparative Example |
| 61 | 4 | 1033 | 66 | 602 | Hot-dip plating | 90 | 7.9 | 2.1 | 29.6 | Electro plating | 99 | 708 | Present Invention Example |
| 62 | 4 | 1030 | 68 | 643 | Hot-dip plating | 88 | 7.7 | 4.3 | 40.7 | Electro plating | 99 | 737 | Present Invention Example |
| 63 | 4 | 967 | 92 | 645 | Hot-dip plating | 92 | 7.9 | 0.1 | 6.3 | Electro plating | 99 | 787 | Comparative Example |
| 64 | 4 | 981 | 56 | 631 | Hot-dip plating | 93 | 6.7 | 0.3 | 8.5 | Electro plating | 99 | 903 | Present Invention Example |
| 65 | 4 | 952 | 64 | 622 | Hot-dip plating | 93 | 5.9 | 1.1 | 23.3 | Electro plating | 99 | 605 | Present Invention Example |

TABLE 2C-continued

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 66 | 4 | 973 | 78 | 622 | Hot-dip plating | 91 | 8.8 | 0.2 | 31.9 | Electro plating | 99 | 975 | Present Invention Example |
| 67 | 4 | 985 | 71 | 649 | Hot-dip plating | 93 | 7.0 | 0.0 | 40.0 | Electro plating | 99 | 621 | Present Invention Example |
| 68 | 4 | 962 | 66 | 630 | Hot-dip plating | 92 | 6.5 | 1.5 | 54.1 | Electro plating | 99 | 846 | Present Invention Example |

Underlines indicate that the corresponding values are outside the scope of the present invention.

TABLE 2D

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 69 | 4 | 970 | 93 | 612 | Hot-dip plating | 93 | 5.2 | 1.8 | 25.6 | Electro plating | 93 | 1003 | Present Invention Example |
| 70 | 4 | 977 | 53 | 639 | Hot-dip plating | 90 | 9.9 | 0.1 | 37.0 | Deposition | 86 | 461 | Comparative Example |
| 71 | 4 | 993 | 73 | 638 | Hot-dip plating | 92 | 6.4 | 1.6 | 33.3 | None | — | — | Comparative Example |
| 72 | 4 | 966 | 92 | 612 | Hot-dip plating | 91 | 9.0 | 0.0 | 35.6 | Electro plating | 96 | 191 | Comparative Example |
| 73 | 4 | 979 | 67 | 622 | Hot-dip plating | 91 | 8.4 | 0.6 | 26.3 | Electro plating | 99 | 213 | Present Invention Example |
| 74 | 4 | 1041 | 72 | 649 | Hot-dip plating | 90 | 8.5 | 1.5 | 33.7 | Electro plating | 99 | 360 | Present Invention Example |
| 75 | 4 | 1025 | 98 | 633 | Hot-dip plating | 90 | 9.0 | 1.0 | 22.2 | Electro plating | 99 | 472 | Present Invention Example |
| 76 | 4 | 1048 | 99 | 629 | Hot-dip plating | 90 | 8.7 | 1.3 | 28.5 | Electro plating | 98 | 775 | Present Invention Example |
| 77 | 4 | 967 | 56 | 620 | Hot-dip plating | 93 | 6.0 | 1.0 | 24.8 | Electro plating | 98 | 1101 | Present Invention Example |
| 78 | 4 | 971 | 60 | 600 | Hot-dip plating | 92 | 6.3 | 1.7 | 25.6 | Electro plating | 99 | 2427 | Present Invention Example |
| 79 | 4 | 957 | 51 | 642 | Hot-dip plating | 89 | 9.6 | 1.4 | 33.7 | Electro plating | 99 | 701 | Present Invention Example |
| 80 | 4 | 1004 | 60 | 622 | Deposition | 92 | 8.0 | 0.0 | 14.8 | Deposition | 100 | 472 | Present Invention Example |
| 81 | 4 | 1030 | 93 | 608 | Thermal spraying | 91 | 7.1 | 1.9 | 45.2 | Deposition | 100 | 584 | Present Invention Example |
| 82 | 4 | 1003 | 100 | 610 | Thermal spraying | 91 | 8.2 | 0.8 | 52.6 | Electro plating | 98 | 607 | Present Invention Example |
| 83 | 4 | 1044 | 95 | 602 | Hot-dip plating | 93 | 6.9 | 0.1 | 33.7 | Deposition | 100 | 483 | Present Invention Example |
| 84 | 4 | 995 | 86 | 639 | Hot-dip plating | 91 | 7.3 | 1.7 | 36.3 | Electro plating | 98 | 1119 | Comparative Example |
| 85 | 4 | 982 | 64 | 618 | Hot-dip plating | 93 | 6.3 | 0.7 | 31.9 | Electro plating | 96 | 924 | Comparative Example |
| 86 | 4 | 1031 | 69 | 613 | Hot-dip plating | 90 | 9.0 | 1.0 | 27.8 | Electro plating | 96 | 1067 | Present Invention Example |
| 87 | 4 | 1031 | 75 | 608 | Hot-dip plating | 91 | 8.6 | 0.4 | 44.4 | Electro plating | 96 | 2191 | Present Invention Example |
| 88 | 4 | 989 | 90 | 615 | Hot-dip plating | 93 | 5.6 | 1.4 | 53.0 | Electro plating | 99 | 2303 | Present Invention Example |

TABLE 2D-continued

| | | Steel sheet manufacturing conditions | | | Steel sheet for hot stamping | | | | | | | | |
|---|---|---|---|---|---|---|---|---|---|---|---|---|---|
| | | Cooling | | Coiling | Al-Si alloy plating layer | | | | | Ni plating layer | | | |
| Test No. | Steel No. | Cooling start temperature (° C.) | Cooling rate (° C./second) | Coiling start temperature (° C.) | Plating method | Al content (mass %) | Si content (mass %) | Impurity (Fe or the like) (mass %) | Thickness of Al-Si alloy plating layer (μm) | Plating method | Ni content (mass %) | Thickness of Ni plating layer (nm) | Note |
| 89 | 4 | 1013 | 95 | 617 | Hot-dip plating | 89 | 10.2 | 0.8 | 37.0 | Electro plating | 99 | 697 | Comparative Example |
| 90 | 4 | 972 | 63 | 632 | None | — | — | — | — | Electro plating | 99 | 550 | Comparative Example |
| 91 | 48 | 983 | 92 | 625 | Hot-dip plating | 92 | 7.7 | 0.3 | 42.0 | Electro plating | 99 | 1203 | Present Invention Example |
| 92 | 49 | 1023 | 85 | 632 | Hot-dip plating | 93 | 6.7 | 0.3 | 33.0 | Electro plating | 99 | 908 | Present Invention Example |
| 93 | 50 | 1005 | 97 | 612 | Hot-dip plating | 92 | 7.7 | 0.3 | 34.0 | Electro plating | 99 | 1020 | Present Invention Example |
| 94 | 51 | 1036 | 99 | 622 | Hot-dip plating | 93 | 6.7 | 0.3 | 32.0 | Electro plating | 99 | 1527 | Present Invention Example |
| 95 | 52 | 982 | 92 | 619 | Hot-dip plating | 93 | 6.7 | 0.3 | 27.0 | Electro plating | 99 | 650 | Present Invention Example |
| 96 | 53 | 1001 | 99 | 642 | Hot-dip plating | 93 | 6.7 | 0.3 | 38.0 | Electro plating | 99 | 982 | Present Invention Example |
| 97 | 54 | 976 | 87 | 638 | Hot-dip plating | 93 | 6.6 | 0.4 | 22.0 | Electro plating | 98 | 1150 | Present Invention Example |
| 98 | 55 | 1034 | 73 | 602 | Hot-dip plating | 91 | 8.4 | 0.6 | 42.0 | Electro plating | 96 | 2191 | Present Invention Example |
| 99 | 4 | 982 | 65 | 624 | Hot-dip plating | 92 | 7.5 | 0.5 | 32.2 | Deposition | 90 | 562 | Comparative Example |
| 100 | 4 | 982 | 65 | 624 | Hot-dip plating | 92 | 7.6 | 0.4 | 33.1 | Deposition | 93 | 574 | Present Invention Example |
| 101 | 4 | 990 | 80 | 632 | Hot-dip plating | 89 | 10.8 | 0.2 | 31.5 | Electro plating | 98 | 992 | Present Invention Example |
| 102 | 4 | 982 | 65 | 624 | Hot-dip plating | 92 | 7.6 | 0.4 | 33.5 | Deposition | 88 | 252 | Comparative Example |

Underlines indicate that the corresponding values are outside the scope of the present invention.

(Al—Si Alloy Plating)

Al—Si alloy plating was provided on the steel sheets manufactured as described above to form Al—Si alloy plating layers. In the plating baths of Al—Si alloys, the components of the plating baths were adjusted such that the Al content and the Si content became as shown in Tables 2A, 2B, 2C and 2D. The steel sheets manufactured by the above-described method were immersed in the plating baths having the adjusted components, thereby obtaining Al—Si alloy-plated steel sheets shown in Tables 2A, 2B, 2C and 2D.

In cases where "thermal spraying" is shown in the "plating method" columns of Tables 2A, 2B, 2C and 2D, the Al—Si alloy plating layers were formed by the following method. A thermal spraying material was prepared by blending individual elements (approximately 50 μm to 200 μm powder). As a thermal spraying method, a plasma arc thermal spraying method was used. A target powder was supplied into plasma generated using an Ar—$H_2$ gas as a working gas with an argon gas. The distance between the thermal spraying gun and the steel sheet was set to 100 mm, and thermal spraying was repeated by moving the thermal spraying gun such that the temperature of the steel sheet did not exceed 200° C., thereby controlling the thickness of the Al—Si alloy plating layer.

In cases where "deposition" is shown in the "plating method" columns of Tables 2A, 2B, 2C and 2D, the Al—Si alloy plating layers were formed by the following method. The distance from a deposition metal source to the steel sheet was set to 0.6 m, the degree of vacuum during deposition was set to $5.0\times10^{-3}$ Pa to $2.0\times10^{-5}$ Pa, electron beams were used as a deposition method, and, as electron beam irradiation conditions, the voltage was set to 10 V (fixed), the current was set to 0.7 to 1.5 A, and the steel sheet temperature was set to 200° C.

(Ni Plating)

Next, Ni plating was provided on the Al—Si alloy plating steel sheets to form Ni plating layers. As a Ni plating bath, a Watt bath containing 200 to 400 g/L of nickel sulfate, 20 to 100 g/L of nickel chloride and 5 to 50 g/L of boric acid was used. The proportions of nickel sulfate, nickel chloride and boric acid were adjusted such that the Ni content became as shown in Tables 2A, 2B, 2C and 2D, the pHs were adjusted to 1.5 to 2.5, and the bath temperatures were adjusted to 45° C. to 55° C. Soluble Ni was used as an anode, the current density was set to 2 A/dm$^2$, and the energization times were controlled such that the average thicknesses became as shown in Tables 2A, 2B, 2C and 2D, thereby obtaining steel sheets for hot stamping. In the steel sheets for hot stamping for which "deposition" is shown in Tables 2A, 2B, 2C and 2D, Ni plating layers were formed not by electro plating but by deposition. Deposition plating was carried out at a degree of vacuum during deposition of $5.0\times10^{-3}$ to $2.0\times10^{-5}$ Pa, and electron beams (voltage: 10 V, current: 1.0 A) were used as a radiation source for deposition.

(Hot Stamping)

Next, the steel sheets for hot stamping were hot-stamped under conditions as shown in Tables 3A, 3B and 3C, thereby obtaining hot stamping members. In Test No. 9, No. 79 and No. 96, tempering was carried out. Specifically, the hot stamping members after the hot stamping were put into a heating furnace (250° C.), retained for 30 minutes and tempered.

TABLE 3A

| | | Hot stamping step | | | | | |
|---|---|---|---|---|---|---|---|
| | | Heating | | | Heating | Post treatment | |
| Test No. | Steel No. | Heating rate (° C./second) | target temperature (° C.) | Retention time (seconds) | Heating elapsed time in temperature range of 450° C. or higher (minutes) | Presence or absence of tempering | Note |
| 1 | 1 | 6.0 | 893 | 66 | 2.3 | Absent | Comparative Example |
| 2 | 2 | 4.7 | 920 | 51 | 2.5 | Absent | Present Invention Example |
| 3 | 3 | 4.6 | 889 | 66 | 2.7 | Absent | Present Invention Example |
| 4 | 4 | 5.3 | 894 | 46 | 2.2 | Absent | Present Invention Example |
| 5 | 5 | 7.4 | 874 | 60 | 2.0 | Absent | Present Invention Example |
| 6 | 6 | 6.4 | 882 | 58 | 2.1 | Absent | Present Invention Example |
| 7 | 7 | 6.2 | 867 | 42 | 1.8 | Absent | Present Invention Example |
| 8 | 8 | 6.4 | 886 | 47 | 1.9 | Absent | Present Invention Example |
| 9 | 9 | 4.2 | 920 | 60 | 2.9 | Present | Present Invention Example |
| 10 | 10 | 7.8 | 862 | 85 | 2.3 | Absent | Present Invention Example |
| 11 | 11 | 7.6 | 866 | 59 | 1.9 | Absent | Present Invention Example |
| 12 | 12 | 7.9 | 885 | 49 | 1.7 | Absent | Present Invention Example |
| 13 | 13 | 7.2 | 903 | 88 | 2.5 | Absent | Present Invention Example |
| 14 | 14 | 7.5 | 898 | 88 | 2.5 | Absent | Present Invention Example |
| 15 | 15 | 5.8 | 902 | 79 | 2.6 | Absent | Present Invention Example |
| 16 | 16 | 4.3 | 883 | 58 | 2.6 | Absent | Present Invention Example |
| 17 | 17 | 4.6 | 863 | 86 | 2.9 | Absent | Present Invention Example |
| 18 | 18 | 4.1 | 908 | 77 | 3.1 | Absent | Present Invention Example |
| 19 | 19 | 6.2 | 889 | 61 | 2.2 | Absent | Present Invention Example |
| 20 | 20 | 4.8 | 912 | 81 | 2.9 | Absent | Present Invention Example |
| 21 | 21 | 6.8 | 870 | 87 | 2.5 | Absent | Present Invention Example |
| 22 | 22 | 7.1 | 888 | 53 | 1.9 | Absent | Present Invention Example |
| 23 | 23 | 5.2 | 886 | 62 | 2.4 | Absent | Present Invention Example |
| 24 | 24 | 5.8 | 912 | 78 | 2.6 | Absent | Present Invention Example |
| 25 | 25 | 7.2 | 879 | 79 | 2.3 | Absent | Present Invention Example |
| 26 | 26 | 6.8 | 885 | 72 | 2.3 | Absent | Present Invention Example |
| 27 | 27 | 4.8 | 882 | 40 | 2.2 | Absent | Present Invention Example |
| 28 | 28 | 7.7 | 862 | 66 | 2.0 | Absent | Present Invention Example |
| 29 | 29 | 5.5 | 889 | 45 | 2.1 | Absent | Present Invention Example |

Underlines indicate that the corresponding values are outside the scope of the present invention.

TABLE 3B

| Test No. | Steel No. | Hot stamping step: Heating: Heating rate (° C./second) | Heating: target temperature (° C.) | Heating: Retention time (seconds) | Heating: Heating elapsed time in temperature range of 450° C. or higher (minutes) | Post treatment: Presence or absence of tempering | Note |
|---|---|---|---|---|---|---|---|
| 30 | 30 | 6.8 | 866 | 80 | 2.3 | Absent | Present Invention Example |
| 31 | 31 | 4.7 | 916 | 54 | 2.6 | Absent | Present Invention Example |
| 32 | 32 | 7.2 | 904 | 58 | 2.0 | Absent | Present Invention Example |
| 33 | 33 | 4.9 | 878 | 52 | 2.3 | Absent | Present Invention Example |
| 34 | 34 | 5.9 | 895 | 49 | 2.1 | Absent | Present Invention Example |
| 35 | 35 | 6.3 | 889 | 69 | 2.3 | Absent | Present Invention Example |
| 36 | 36 | 5.5 | 863 | 89 | 2.7 | Absent | Present Invention Example |
| 37 | 37 | 4.6 | 905 | 49 | 2.5 | Absent | Present Invention Example |
| 38 | 38 | 6.5 | 869 | 73 | 2.3 | Absent | Present Invention Example |
| 39 | 39 | 7.1 | 867 | 70 | 2.1 | Absent | Present Invention Example |
| 40 | 40 | 5.6 | 908 | 64 | 2.4 | Absent | Present Invention Example |
| 41 | 41 | 6.2 | 884 | 82 | 2.5 | Absent | Present Invention Example |
| 42 | 42 | 4.4 | 894 | 50 | 2.5 | Absent | Present Invention Example |
| 43 | 43 | 6.3 | 905 | 67 | 2.3 | Absent | Present Invention Example |
| 44 | 44 | 7.5 | 877 | 56 | 1.9 | Absent | Present Invention Example |
| 45 | 45 | 6.1 | 880 | 60 | 2.2 | Absent | Present Invention Example |
| 46 | 46 | 4.7 | 908 | 82 | 3.0 | Absent | Present Invention Example |
| 47 | 47 | 4.3 | 876 | 57 | 2.6 | Absent | Present Invention Example |
| 48 | 4 | 6.6 | 868 | 46 | 1.8 | Absent | Present Invention Example |
| 49 | 4 | 6.3 | 901 | 81 | 2.5 | Absent | Present Invention Example |
| 50 | 4 | 6.0 | 911 | 72 | 2.5 | Absent | Present Invention Example |
| 51 | 4 | 5.5 | 862 | 88 | 2.7 | Absent | Present Invention Example |
| 52 | 4 | 6.3 | 885 | 51 | 2.0 | Absent | Present Invention Example |
| 53 | 4 | 4.3 | 909 | 63 | 2.8 | Absent | Present Invention Example |
| 54 | 4 | 7.8 | 919 | 45 | 1.8 | Absent | Comparative Example |
| 55 | 4 | 6.2 | 872 | 60 | 2.1 | Absent | Present Invention Example |
| 56 | 4 | 4.3 | 910 | 62 | 2.8 | Absent | Present Invention Example |
| 57 | 4 | 4.7 | 878 | 51 | 2.4 | Absent | Present Invention Example |
| 58 | 4 | 6.0 | 916 | 65 | 2.4 | Absent | Present Invention Example |
| 59 | 4 | 7.5 | 881 | 78 | 2.3 | Absent | Present Invention Example |

Underlines indicate that the corresponding values are outside the scope of the present invention.

TABLE 3C

| Test No. | Steel No. | Hot stamping step: Heating: Heating rate (° C./second) | Heating: target temperature (° C.) | Heating: Retention time (seconds) | Heating: Heating elapsed time in temperature range of 450° C. or higher (minutes) | Post treatment: Presence or absence of tempering | Note |
|---|---|---|---|---|---|---|---|
| 60 | 4 | 5.7 | 897 | 67 | 2.4 | Absent | Comparative Example |
| 61 | 4 | 5.9 | 900 | 45 | 2.0 | Absent | Present Invention Example |
| 62 | 4 | 5.3 | 862 | 42 | 2.0 | Absent | Present Invention Example |
| 63 | 4 | 6.6 | 910 | 62 | 2.2 | Absent | Comparative Example |
| 64 | 4 | 6.5 | 906 | 60 | 2.2 | Absent | Present Invention Example |
| 65 | 4 | 5.6 | 907 | 64 | 2.4 | Absent | Present Invention Example |
| 66 | 4 | 7.2 | 910 | 79 | 2.4 | Absent | Present Invention Example |
| 67 | 4 | 4.8 | 909 | 61 | 2.6 | Absent | Present Invention Example |
| 68 | 4 | 5.0 | 887 | 86 | 2.9 | Absent | Present Invention Example |
| 69 | 4 | 5.7 | 896 | 87 | 2.8 | Absent | Present Invention Example |
| 70 | 4 | 5.4 | 908 | 80 | 2.7 | Absent | Comparative Example |
| 71 | 4 | 4.5 | 910 | 69 | 2.9 | Absent | Comparative Example |
| 72 | 4 | 7.8 | 894 | 41 | 1.6 | Absent | Comparative Example |
| 73 | 4 | 5.7 | 869 | 53 | 2.1 | Absent | Present Invention Example |
| 74 | 4 | 6.4 | 880 | 49 | 1.9 | Absent | Present Invention Example |
| 75 | 4 | 4.1 | 889 | 60 | 2.8 | Absent | Present Invention Example |
| 76 | 4 | 6.8 | 892 | 45 | 1.8 | Absent | Present Invention Example |
| 77 | 4 | 7.1 | 914 | 45 | 1.8 | Absent | Present Invention Example |
| 78 | 4 | 3.2 | 1000 | 57 | 3.8 | Absent | Present Invention Example |
| 79 | 4 | 7.2 | 878 | 70 | 2.2 | Present | Present Invention Example |
| 80 | 4 | 7.1 | 860 | 43 | 1.7 | Absent | Present Invention Example |
| 81 | 4 | 7.3 | 908 | 52 | 1.9 | Absent | Present Invention Example |
| 82 | 4 | 6.7 | 890 | 45 | 1.8 | Absent | Present Invention Example |
| 83 | 4 | 7.3 | 900 | 50 | 1.9 | Absent | Present Invention Example |

TABLE 3C-continued

| | | Hot stamping step | | | | | |
|---|---|---|---|---|---|---|---|
| | | Heating | | | Heating elapsed time | Post treatment | |
| Test No. | Steel No. | Heating rate (° C./second) | target temperature (° C.) | Retention time (seconds) | in temperature range of 450° C. or higher (minutes) | Presence or absence of tempering | Note |
| 84 | 4 | 1.2 | 900 | 75 | 7.5 | Absent | Comparative Example |
| 85 | 4 | 10.8 | 918 | 60 | 1.7 | Absent | Comparative Example |
| 86 | 4 | 9.3 | 1192 | 56 | 2.3 | Absent | Present Invention Example |
| 87 | 4 | 8.5 | 850 | 200 | 4.1 | Absent | Present Invention Example |
| 88 | 4 | 7.3 | 930 | 290 | 5.9 | Absent | Present Invention Example |
| 89 | 4 | 5.2 | 850 | 350 | 7.1 | Absent | Comparative Example |
| 90 | 4 | 4.3 | 892 | 60 | 2.7 | Absent | Comparative Example |
| 91 | 48 | 5.2 | 890 | 60 | 2.4 | Absent | Present Invention Example |
| 92 | 49 | 5.8 | 888 | 59 | 2.2 | Absent | Present Invention Example |
| 93 | 50 | 5 | 912 | 61 | 2.6 | Absent | Present Invention Example |
| 94 | 51 | 4.1 | 904 | 60 | 2.8 | Absent | Present Invention Example |
| 95 | 52 | 4.2 | 890 | 80 | 3.1 | Absent | Present Invention Example |
| 96 | 53 | 3.8 | 921 | 64 | 3.1 | Present | Present Invention Example |
| 97 | 54 | 3.7 | 1005 | 55 | 3.4 | Absent | Present Invention Example |
| 98 | 55 | 8.5 | 952 | 200 | 4.3 | Absent | Present Invention Example |
| 99 | 4 | 4.1 | 1070 | 80 | 3.9 | Absent | Comparative Example |
| 100 | 4 | 4.1 | 1071 | 80 | 3.9 | Absent | Present Invention Example |
| 101 | 4 | 5.1 | 902 | 45 | 2.2 | Absent | Present Invention Example |
| 102 | 4 | 4.1 | 1052 | 80 | 3.8 | Absent | Comparative Example |

Underlines indicate that the corresponding values are outside the scope of the present invention.

(Average Thickness of Al—Si Alloy Plating Layer)

The average thickness of the Al—Si alloy plating layer of the steel sheet for hot stamping was measured as described below. The steel sheet for hot stamping obtained by the above-described manufacturing method was cut in the sheet thickness direction. After that, the cross section of the steel sheet for hot stamping was polished, in the polished cross section of the steel sheet for hot stamping, a region from the surface of the steel sheet for hot stamping to the steel sheet was linearly analyzed by field emission electron probe microanalysis (FE-EPMA), and the Al concentration and the Si concentration in the detected components were measured. As the measurement conditions, the accelerating voltage was set to 15 kV, the beam diameter was set to approximately 100 nm, the irradiation time per point was set to 1000 ms, and the measurement pitches were set to 60 nm. The measurement was carried out in a range where the Ni plating layer, the Al—Si alloy plating layer and the steel sheet were included. A region where the Al content was 75 mass % or more, the Si content was 3 mass % or more and the total of the Al content and the Si content was 95 mass % or more was determined as the Al—Si alloy plating layer, and the thickness of the Al—Si alloy plating layer was regarded as the length of the region in the sheet thickness direction. The thicknesses of the Al—Si alloy plating layer were measured at five positions at 5 μm intervals, and the arithmetic average of the obtained values was regarded as the average thickness of the Al—Si alloy plating layer. The evaluation results are shown in Tables 2A, 2B, 2C and 2D.

(Measurement of Al Content and Si Content in Al—Si Alloy Plating Layer)

Regarding the Al content and the Si content in the Al—Si alloy plating layer of the steel sheet for hot stamping, according to a testing method described in JIS K 0150 (2005), a test piece was collected, and the Al content and the Si content were measured at a ½ position of the thickness of the Al—Si alloy plating layer, thereby obtaining the Al content and the Si content in the Al—Si alloy plating layer in the steel sheet for hot stamping. The obtained results are shown in Tables 2A, 2B, 2C and 2D.

(Average Thickness of Ni Plating Layer)

The average thickness of the Ni plating layer of the steel sheet for hot stamping was measured by alternately repeating Ar sputtering etching and X-ray photoelectron spectroscopy (XPS) measurement. Specifically, the hot stamping member was sputtering-etched by Ar sputtering (accelerating voltage: 20 kV, sputtering rate: 1.0 nm/min), and then XPS measurement was carried out. The Ar sputtering etching and the XPS measurement were alternately carried out, and these measurements were repeated until a peak with a bonding energy of the 2p orbit of Ni in the XPS measurement of 852.5 eV to 852.9 eV appeared and then disappeared. The thickness of the Ni plating layer was calculated from the sputtering etching time and the sputtering etching rate while the peak in the above-described range from a position where the Ni content reached 10 atomic % or more for the first time after the start of the sputtering to a position where the Ni content reached less than 10 atomic % appeared and then disappeared. The sputtering etching rate was obtained in terms of $SiO_2$. The average thickness of the Ni plating layer 4 was the arithmetic average value of two measurement sites. The evaluation results are shown in Tables 2A, 2B, 2C and 2D.

(Ni Content of Ni Plating Layer)

Regarding the Ni content in the Ni plating layer, the Ni concentration at the central position in the sheet thickness direction of the Ni plating layer that was obtained in the measurement of the average thickness of the Ni plating layer was regarded as the Ni content. As the Ni content, the arithmetic average value of values measured at the above-described two sites. The obtained results are shown in Tables 2A, 2B, 2C and 2D.

(Depth Profile of Plating Layer)

The depth profile of each element in the plating layer of the hot stamping member was obtained by GDS. As conditions, the inter-electrode distance was set to 0.19 mm, and high frequencies were applied from the rear surface of a sample. The depth profile was measured under a discharge voltage of 35 W (constant power mode), an Ar pressure during the measurement of 600 Pa and a discharge range of 4 mmϕ. The measurement time at one site was approximately 12 minutes, and the plating layer was etched approximately 50 μm. The depth of the plating layer was calculated by the above-described method. When the measurement was carried out from the surface of the hot stamping member to a region where the Fe element in the base material was stabilized, the depth profile of each element was obtained.

In the region from the surface of the plating layer of the hot stamping member to the 100 nm position in the thickness direction from the surface of the plating layer of the hot stamping member, a case where the Fe content was 5 mass % or less was indicated by I, a case where the Fe content was 10 mass % or less was indicated by II, and a case where the Fe content was more than 10 mass % was indicated by III. In addition, a case where the maximum value of the Ni content was 70 mass % or more was indicated by I, a case where the maximum value of the Ni content was 50 mass % or more and less than 70 mass % was indicated by II, a case where the maximum value of the Ni content was less than 50 mass % was indicated by III, a case where the maximum value of the Al content was 5 mass % or more was indicated by I, a case where the maximum value of the Al content was 1 mass % or more and less than 5 mass % was indicated by II, and a case where the maximum value of the Ni content was less than 1 mass % was indicated by III.

In the region from the 100 nm position in the thickness direction from the surface of the plating layer of the hot stamping member to the 500 nm position in the thickness direction from the surface of the plating layer of the hot stamping member, a case where the Fe content was 15 mass % or less was indicated by I, a case where the Fe content was 25 mass % or less was indicated by II, and a case where the Fe content was more than 25 mass % was indicated by III. In addition, a case where the maximum value of the Ni content was 10 mass % or more was indicated by I, a case where the maximum value of the Ni content was 5 mass % or more and less than 10 mass % was indicated by II, and a case where the maximum value of the Ni content was less than 5 mass % was indicated by III.

In the region from the 500 nm position in the thickness direction from the surface of the plating layer of the hot stamping member to the 1000 nm position in the thickness direction from the surface of the plating layer of the hot stamping member, a case where the Fe content was 20 mass % or less was indicated by I, a case where the Fe content was 20 mass % or more and 30 mass % or less was indicated by II, and a case where the Fe content was more than 30 mass % was indicated by III. In addition, a case where the maximum value of the Ni content was 5 mass % or more was indicated by I, a case where the maximum value of the Ni content was 1 mass % or more and less than 5 mass % was indicated by II, and a case where the maximum value of the Ni content was less than 1 mass % was indicated by III.

Regarding the determination of the region up to 1000 nm from the surface in Tables 4A, 4B and 4C, a case where all of the regions were each evaluated as I or II was evaluated as acceptable, and G was entered. Regarding the determination of the Fe content and the Ni content, a case where even one of the contents was evaluated as III was evaluated as unacceptable, and B was entered.

The results are shown in Tables 4A, 4B and 4C. In No. 85, since the external appearance became poor due to rapid heating, measurement was not carried out. The region (0 to 100 nm) in Tables 4A, 4B and 4C means the region from the surface of the plating layer to the 100 nm position in the thickness direction from the surface of the plating layer. The region (100 to 500 nm) in Tables 4A, 4B and 4C means the region from the 100 nm position in the thickness direction from the surface of the plating layer to the 500 nm position in the thickness direction from the surface of the plating layer. The region (500 to 1000 nm) in Tables 4A, 4B and 4C means the region from the 500 nm position in the thickness direction from the surface of the plating layer to the 1000 nm position in the thickness direction from the surface of the plating layer.

(Ni Oxide and Ni Hydroxide in Region from Surface of Plating Layer to 20 nm Position in Thickness Direction from Surface of Plating Layer)

The presence of a Ni oxide and a Ni hydroxide in the region from the surface of the plating layer to the 20 nm position in the thickness direction from the surface of the plating layer was confirmed by X-ray photoelectron spectroscopy measurement (XPS measurement). Specifically, the hot stamping member was sputtering-etched by Ar sputtering (accelerating voltage: 20 kV, sputtering rate: 1.0 nm/min), and then XPS measurement was carried out. The XPS measurement was carried out by scanning the outermost surface of the hot stamping member in the entire energy range using Quantum 2000 manufactured by ULVAC-PHI, Inc. and Al Kα rays as a radiation source under conditions of an output of 15 kV, 25 W, a spot size of 100 μm and the number of times of scanning of 10 times. The Ar sputtering etching and the XPS measurement were alternately carried out, and these measurements were repeated up to the 20 nm position in the thickness direction from the plating layer. The depth from the surface of the plating layer was calculated from the sputtering etching time and the sputtering rate. In a case where a peak is detected at 854 eV to 857 eV that are derived from the 2p orbit of the Ni oxide or the Ni hydroxide in the region from the surface of the plating layer to the 20 nm position in the thickness direction from the surface of the plating layer of the hot stamping member, at least one of the Ni oxide and the Ni hydroxide is determined to be present on the surface of the plating layer. The sputtering etching rate was obtained in terms of $SiO_2$. In addition, the Ni content in the region from the surface of the plating layer to the 20 nm position in the thickness direction from the surface of the plating layer of the hot stamping member was obtained by calculation from all elements detected by the XPS measurement. In No. 85, since the external appearance became poor due to rapid heating, measurement was not carried out.

(Determination of Region up to 20 nm Position from Surface)

In the region from the surface of the plating layer to a 20 nm position in the thickness direction from the surface of the plating layer, in a case where at least one of a Ni oxide and a Ni hydroxide was present and the Ni content was 30 mass % or more, G was entered, and, in the other cases, B was entered. The results are shown in Tables 4A, 4B and 4C. In No. 85, since the external appearance became poor due to rapid heating, determination was not carried out.

(Determination of Each Rich Region)

From the GDS measurement results of the depth profile of each element of the plating layer of the hot stamping member, in a case where individual regions of the Ni-rich region (the Ni content: 50 mass % or more), the Al-rich region (the Ni content: less than 50 mass %, the Al content: 10 mass % or more, the Fe content: 50 mass % or less) and the Fe-rich region (the Al content: 10 mass % or more, the Fe content: more than 50 mass %) of the plating layer were provided in this order from the surface of the plating layer (determination of each rich region), G was entered, and, in a case where these individual regions were not provided, B was entered. In No. 85, since the external appearance became poor due to rapid heating, determination was not carried out.

(Corrosion Resistance)

The corrosion resistance of the hot stamping member was evaluated by a cyclic neutral salt spray test (CCT) based on 8.1 of JIS H8502: 1999. However, 8.1.2b) of the above-described regulation was changed such that sodium chloride was dissolved so as to be 10 g per liter of a testing solution. Specifically, the hot stamping member was taken out after 3 cycles of CCT, 9 cycles of CCT, 15 cycles of CCT and 30 cycles of CCT, and the metallic gloss retention rates of the base material were evaluated. A case where 60% or more of the metallic gloss of the base material was retained until 30 cycles of CCT was evaluated as A, a case where 60% or more of the metallic gloss of the base material was retained until 15 cycles of CCT was evaluated as B, a case where 60% or more of the metallic gloss of the base material was retained until 9 cycles of CCT was evaluated as C, a case where 60% or more of the metallic gloss of the base material was retained until 3 cycles of CCT was evaluated as D, and, a case where 60% or more of the metallic gloss of the base material could not be retained until 3 cycles of CCT was evaluated as E. A to D were regarded as acceptable, and E was regarded as unacceptable. The results are shown in Tables 4A to 4C. In Test No. 85, since the external appearance became poor, the corrosion resistance test was not carried out.

TABLE 4A

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 1 | 1 | II | II | I | III | II | III | III | B | B | G | E | Comparative Example |
| 2 | 2 | I | I | I | T | I | T | T | G | G | G | A | Present Invention Example |
| 3 | 3 | I | I | I | I | I | I | I | G | G | G | A | Present Invention Example |
| 4 | 4 | I | I | I | I | I | I | I | G | G | G | A | Present Invention Example |
| 5 | 5 | I | I | I | I | I | I | I | G | G | G | A | Present Invention Example |
| 6 | 6 | I | I | I | I | I | I | I | G | G | G | A | Present Invention Example |
| 7 | 7 | I | I | I | I | I | I | I | G | G | G | A | Present Invention Example |
| 8 | 8 | I | I | I | I | I | I | I | G | G | G | A | Present Invention Example |
| 9 | 9 | I | I | I | I | I | I | I | G | G | G | A | Present Invention Example |
| 10 | 10 | I | I | I | I | I | I | I | G | G | G | A | Present Invention Example |
| 11 | 11 | I | I | I | I | I | I | I | G | G | G | A | Present Invention Example |
| 12 | 12 | I | I | I | I | I | I | I | G | G | G | A | Present Invention Example |
| 13 | 13 | I | I | I | I | I | I | I | G | G | G | A | Present Invention Example |
| 14 | 14 | I | I | I | I | I | I | I | G | G | G | A | Present Invention Example |
| 15 | 15 | I | I | I | I | I | I | I | G | G | G | A | Present Invention Example |
| 16 | 16 | I | I | I | I | I | I | I | G | G | G | A | Present Invention Example |
| 17 | 17 | I | I | I | I | I | I | I | G | G | G | A | Present Invention Example |
| 18 | 18 | I | I | I | I | I | I | I | G | G | G | A | Present Invention Example |
| 19 | 19 | I | I | I | I | I | I | I | G | G | G | A | Present Invention Example |
| 20 | 20 | I | I | I | I | I | I | I | G | G | G | A | Present Invention Example |
| 21 | 21 | I | I | I | I | I | I | I | G | G | G | A | Present Invention Example |
| 22 | 22 | I | I | I | I | I | I | I | G | G | G | A | Present Invention Example |

TABLE 4A-continued

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 23 | 23 | I | I | I | I | I | I | I | G | G | G | A | Present Invention Example |
| 24 | 24 | I | I | I | I | I | I | I | G | G | G | A | Present Invention Example |
| 25 | 25 | I | I | I | I | I | I | I | G | G | G | A | Present Invention Example |
| 26 | 26 | I | I | I | I | I | I | I | G | G | G | A | Present Invention Example |
| 27 | 27 | I | I | I | I | I | I | I | G | G | G | A | Present Invention Example |
| 28 | 28 | I | I | I | I | I | I | I | G | G | G | A | Present Invention Example |
| 29 | 29 | I | I | I | I | I | I | I | G | G | G | A | Present Invention Example |

Underlines indicate that the corresponding values are outside the scope of the present invention

TABLE 4B

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 30 | 30 | I | I | I | I | I | I | I | G | G | G | A | Present Invention Example |
| 31 | 31 | 1 | I | I | I | I | I | I | G | G | G | A | Present Invention Example |
| 32 | 32 | I | I | I | I | I | I | I | G | G | G | A | Present Invention Example |
| 33 | 33 | I | I | I | I | I | I | I | G | G | G | A | Present Invention Example |
| 34 | 34 | I | I | I | I | I | I | I | G | G | G | A | Present Invention Example |
| 35 | 35 | I | I | I | I | I | I | I | G | G | G | A | Present Invention Example |
| 36 | 36 | I | I | I | I | I | I | I | G | G | G | A | Present Invention Example |
| 37 | 37 | I | I | I | I | I | I | I | G | G | G | A | Present Invention Example |
| 38 | 38 | I | I | I | I | I | I | I | G | G | G | A | Present Invention Example |
| 39 | 39 | I | I | I | I | I | I | I | G | G | G | A | Present Invention Example |
| 40 | 40 | I | I | I | I | I | I | I | G | G | G | A | Present Invention Example |
| 41 | 41 | I | I | I | I | I | I | I | G | G | G | A | Present Invention Example |
| 42 | 42 | I | I | I | I | I | I | I | G | G | G | A | Present Invention Example |
| 43 | 43 | I | I | I | I | I | I | I | G | G | G | A | Present Invention Example |
| 44 | 44 | I | I | I | I | I | I | I | G | G | G | A | Present Invention Example |
| 45 | 45 | I | I | I | I | I | I | I | G | G | G | A | Present Invention Example |
| 46 | 46 | I | I | I | I | I | I | I | G | G | G | A | Present Invention Example |
| 47 | 47 | I | I | I | I | I | I | I | G | G | G | A | Present Invention Example |
| 48 | 4 | I | I | I | I | I | I | I | G | G | G | A | Present Invention Example |
| 49 | 4 | I | I | I | I | I | I | I | G | G | G | A | Present Invention Example |
| 50 | 4 | I | I | I | I | I | I | I | G | G | G | A | Present Invention Example |

TABLE 4B-continued

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 51 | 4 | I | I | I | I | I | I | I | G | G | G | A | Present Invention Example |
| 52 | 4 | I | I | I | I | I | I | I | G | G | G | A | Present Invention Example |
| 53 | 4 | I | I | I | I | I | I | I | G | G | G | A | Present Invention Example |
| 54 | 4 | II | II | I | III | II | III | II | B | G | G | E | Comparative Example |
| 55 | 4 | I | I | I | I | I | I | I | G | G | G | C | Present Invention Example |
| 56 | 4 | I | I | I | I | I | I | I | G | G | G | A | Present Invention Example |
| 57 | 4 | I | I | I | I | I | I | I | G | G | G | A | Present Invention Example |
| 58 | 4 | I | I | I | I | I | I | I | G | G | G | A | Present Invention Example |
| 59 | 4 | I | I | I | II | I | II | I | G | G | G | C | Present Invention Example |

Underlines indicate that the corresponding values are outside the scope of the present invention.

TABLE 4C

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 60 | 4 | II | II | I | III | II | III | I | B | G | G | E | Comparative Example |
| 61 | 4 | I | I | I | I | I | I | I | G | G | G | A | Present Invention Example |
| 62 | 4 | I | I | I | I | I | I | I | G | G | G | A | Present Invention Example |
| 63 | 4 | I | I | I | III | II | III | I | B | G | G | E | Comparative Example |
| 64 | 4 | I | I | I | I | I | I | I | G | G | G | A | Present Invention Example |
| 65 | 4 | I | I | I | I | I | I | I | G | G | G | A | Present Invention Example |
| 66 | 4 | I | I | I | I | I | I | I | G | G | G | A | Present Invention Example |
| 67 | 4 | I | I | I | I | I | I | I | G | G | G | A | Present Invention Example |
| 68 | 4 | I | I | I | I | I | I | I | G | G | G | A | Present Invention Example |
| 69 | 4 | I | I | I | I | I | I | I | G | G | G | A | Present Invention Example |
| 70 | 4 | II | II | I | II | I | III | I | B | B | G | E | Comparative Example |
| 71 | 4 | III | III | I | III | III | III | III | B | B | B | E | Comparative Example |
| 72 | 4 | II | II | I | III | I | III | I | B | B | G | E | Comparative Example |
| 73 | 4 | II | II | I | II | II | II | I | G | G | G | D | Present Invention Example |
| 74 | 4 | I | I | I | II | I | II | I | G | G | G | C | Present Invention Example |
| 75 | 4 | I | I | I | I | I | II | I | G | G | G | B | Present Invention Example |
| 76 | 4 | I | I | I | I | I | I | I | G | G | G | A | Present Invention Example |
| 77 | 4 | I | I | I | I | I | I | I | G | G | G | A | Present Invention Example |
| 78 | 4 | I | I | I | I | I | I | I | G | G | G | A | Present Invention Example |
| 79 | 4 | I | I | I | I | I | I | I | G | G | G | A | Present Invention Example |
| 80 | 4 | I | I | I | I | I | I | I | G | G | G | A | Present Invention Example |
| 81 | 4 | I | I | I | I | I | I | I | G | G | G | A | Present Invention Example |
| 82 | 4 | I | I | I | I | I | I | I | G | G | G | A | Present Invention Example |
| 83 | 4 | I | I | I | I | I | I | I | G | G | G | A | Present Invention Example |

TABLE 4C-continued

| Test No. | Steel No. | Region (0 to 100 nm) Fe (mass %) | Region (0 to 100 nm) Ni (mass %) | Region (0 to 100 nm) Al (mass %) | Region (100 to 500 nm) Fe (mass %) | Region (100 to 500 nm) Ni (mass %) | Region (500 to 1000 nm) Fe (mass %) | Region (500 to 1000 nm) Ni (mass %) | Determination of region up to 1000 nm from surface | Determination of region up to 20 nm position from surface | Determination of each rich region | Performance Corrosion resistance Metallic gloss retention rate | Note |
|---|---|---|---|---|---|---|---|---|---|---|---|---|---|
| 84 | 4 | III | II | I | III | II | III | I | B | B | G | E | Comparative Example |
| 85 | 4 | — | — | — | — | — | — | — | — | — | — | — | Comparative Example |
| 86 | 4 | I | I | I | I | I | I | I | G | G | G | A | Present Invention Example |
| 87 | 4 | I | I | I | I | I | II | I | G | G | G | B | Present Invention Example |
| 88 | 4 | I | I | I | II | I | II | I | G | G | G | C | Present Invention Example |
| 89 | 4 | III | II | I | III | I | III | I | B | G | G | E | Comparative Example |
| 90 | 4 | I | II | III | III | I | III | I | G | G | G | E | Comparative Example |
| 91 | 48 | I | I | I | I | I | I | I | G | G | G | A | Present Invention Example |
| 92 | 49 | I | I | I | I | I | I | I | G | G | G | A | Present Invention Example |
| 93 | 50 | I | I | I | I | I | I | I | G | G | G | A | Present Invention Example |
| 94 | 51 | I | I | I | I | I | I | I | G | G | G | A | Present Invention Example |
| 95 | 52 | I | I | I | I | I | I | I | G | G | G | A | Present Invention Example |
| 96 | 53 | I | I | I | I | I | I | I | G | G | G | A | Present Invention Example |
| 97 | 54 | I | I | I | I | I | I | I | G | G | G | A | Present Invention Example |
| 98 | 55 | I | I | I | I | I | II | I | G | G | G | B | Present Invention Example |
| 99 | 4 | II | III | I | II | II | III | I | B | B | B | E | Comparative Example |
| 100 | 4 | II | II | I | II | I | II | I | G | G | G | D | Present Invention Example |
| 101 | 4 | I | I | I | I | I | I | I | G | G | G | A | Present Invention Example |
| 102 | 4 | III | II | I | III | I | III | I | B | B | G | E | Comparative Example |

Underlines indicate that the corresponding values are outside the scope of the present invention.

As shown in Tables 4A, 4B and 4C, in Test Nos. 2 to 53, 55 to 59, 61, 62, 64 to 69, 73 to 83, 86 to 88, 91 to 98, 100 and 101 according to the present invention examples, excellent corrosion resistance was exhibited. In addition, in Test Nos. 2 to 53, 55 to 59, 61, 62, 64 to 69, 73 to 83, 86 to 88, 91 to 98, 100 and 101 according to the present invention examples, the individual regions of the Ni-rich region (the Ni content: 50 mass % or more), the Al-rich region (the Ni content: less than 50 mass %, the Al content: 10 mass % or more, the Fe content: 50 mass % or less) and the Fe-rich region (the Al content: 10 mass % or more, the Fe content: more than 50 mass %) of the plating layer were provided in this order from the surface of the plating layer.

In Test No. 1, since the thickness of the Ni plating layer of the steel sheet for hot stamping was not more than 200 nm, it was not possible to sufficiently suppress the diffusion of Fe. Therefore, the corrosion resistance was poor in Test No. 1.

In Test No. 54, since the Si content of the Al—Si alloy plating layer of the steel sheet for hot stamping was less than 3%, the alloying of Fe and Al excessively proceeded. Therefore, the corrosion resistance was poor in Test No. 54.

In Test No. 60, since Si in the Al—Si alloy plating layer of the steel sheet for hot stamping was more than 20%, the main body of an alloy layer of Fe and Al was $FeAl_5Si$, and the Fe—Al alloy layer grew in a rod shape. Therefore, it becomes easy for Fe to diffuse into the surface of the hot stamping member. Therefore, the corrosion resistance was poor in Test No. 60.

In Test No. 63, since the thickness of the Al—Si alloy plating layer of the steel sheet for hot stamping was less than 7 μm, it was not possible to sufficiently suppress the diffusion of Fe. Therefore, the corrosion resistance was poor in Test No. 63.

In Test No. 70, since the Ni content of the Ni plating layer of the steel sheet for hot stamping was not more than 90%, it was not possible to sufficiently suppress the diffusion of Fe in the region from 100 nm in the thickness direction from the surface of the plating layer to the 1000 nm position in the thickness direction from the surface of the plating layer of the hot stamping member. Therefore, the corrosion resistance was poor in Test No. 70.

In Test No. 71, since no Ni plating layer was provided in the steel sheet for hot stamping, it was not possible to sufficiently suppress the diffusion of Fe. Therefore, the corrosion resistance was poor in Test No. 71.

In Test No. 72, the thickness of the Ni plating layer of the steel sheet for hot stamping was not more than 200 nm. Therefore, it was not possible to sufficiently suppress the diffusion of Fe. Therefore, the corrosion resistance was poor in Test No. 72.

In Test No. 84, since the heating speed during the hot stamping was 1.2° C./second, it was not possible to sufficiently suppress the diffusion of Fe. Therefore, the corrosion resistance was poor in Test No. 84.

In Test No. 85, since the heating speed during the hot stamping was 10.8° C./second, the external appearance was poor.

In Test No. 89, since the retention time during the hot stamping and the heating elapsed time in a temperature range of 450° C. or higher were long, it was not possible to sufficiently suppress the diffusion of Fe. Therefore, the corrosion resistance was poor in Test No. 89.

In Test No. 90, since no Al—Si alloy plating layer was provided, there was not Al-rich region, and the diffusion of Fe could not be sufficiently suppressed. Therefore, the corrosion resistance was poor in Test No. 90.

In Test No. 99, since the Ni content of the Ni plating layer was 90 mass %, it was not possible to sufficiently suppress the diffusion of Fe in the region from 100 nm in the thickness direction from the surface of the plating layer to the 1000 nm position in the thickness direction from the surface of the plating layer of the hot stamping member. Therefore, the corrosion resistance was poor.

In Test No. 102, since the Ni content of the Ni plating layer was 88 mass %, it was not possible to sufficiently suppress the diffusion of Fe in the region from 100 nm in the thickness direction from the surface of the plating layer to the 1000 nm position in the thickness direction from the surface of the plating layer of the hot stamping member. Therefore, the corrosion resistance was poor.

INDUSTRIAL APPLICABILITY

According to the present invention, even when a plating layer containing Ni and Al is present on the surface of a hot stamping member, the corrosion resistance is excellent, and thus the present invention is highly applicable industrially.

The invention claimed is:

1. A hot stamping member comprising:

a base material; and a plating region provided on the base material, wherein the plating region has, in this order from a surface of the plating region:

a region A, which is defined as a region where a Ni content is 50 mass % or more, a region B, which is defined as a region where a Ni content is less than 50 mass %, an Al content is 10 mass % or more, and an Fe content is 50 mass % or less, and a region C, which is defined as a region where an Al content is 10 mass % or more and an Fe content is more than 50 mass %, and wherein in a region from the surface of the plating region to a position 100 nm from the surface of the plating region in a thickness direction, a maximum value of a Ni content is 50 mass % or more, an Fe content is 10 mass % or less, and a ratio Ni/Cr of the Ni content, in mass %, to a content of Cr, in mass %, is 15 or more, in a region from the position 100 nm from the surface of the plating region in the thickness direction to a position 500 nm from the surface of the plating region in the thickness direction, a maximum value of a Ni content is 5 mass % or more, and an Fe content is 25 mass % or less, and in a region from the position 500 nm from the surface of the plating region in the thickness direction to a position 1000 nm from the surface of the plating region in the thickness direction, a maximum value of a Ni content is 1 mass % or more, and an Fe content is 30 mass % or less.

2. The hot stamping member according to claim 1, wherein, in a region from the surface of the plating region to a position 20 nm from the surface of the plating region in the thickness direction, at least one of a Ni oxide and a Ni hydroxide is present, and a Ni content is 30 mass % or more.

3. The hot stamping member according to claim 1, wherein the chemical composition of the base material comprises, by mass %, C: 0.01% or more and less than 0.70%;

Si: 0.005% to 1.000%;

Mn: 0.15% to 3.00%;
sol. Al: 0.00020% to 0.50000%;
P: 0.100% or less;
S: 0.1000% or less;
N: 0.0100% or less;
Cu: 0% to 1.00%;
Ni: 0% to 1.00%;
Nb: 0% to 0.150%;
V: 0% to 1.000%;
Ti: 0% to 0.150%;
Mo: 0% to 1.000%;
Cr: 0% to 1.000%;
B: 0% to 0.0100%;
Ca: 0% to 0.010%;
REM: 0% to 0.300%; and
a remainder: Fe and impurities.

4. The hot stamping member according to claim 3, wherein the chemical composition of the base material contains, by mass %, one or more selected from:
Cu: 0.005% to 1.00%;
Ni: 0.005% to 1.00%;
Nb: 0.010% to 0.150%;
V: 0.005% to 1.000%;
Ti: 0.010% to 0.150%;
Mo: 0.005% to 1.000%;
Cr: 0.050% to 1.000%;
B: 0.0005% to 0.0100%;
Ca: 0.001% to 0.010%; and
REM: 0.001% to 0.300% or less.

5. The hot stamping member according to claim 2, wherein the chemical composition of the base material comprises, by mass %,
C: 0.01% or more and less than 0.70%;
Si: 0.005% to 1.000%;
Mn: 0.15% to 3.00%;
sol. Al: 0.00020% to 0.50000%;
P: 0.100% or less;
S: 0.1000% or less;
N: 0.0100% or less;
Cu: 0% to 1.00%;
Ni: 0% to 1.00%;
Nb: 0% to 0.150%;
V: 0% to 1.000%;
Ti: 0% to 0.150%;
Mo: 0% to 1.000%;
Cr: 0% to 1.000%;
B: 0% to 0.0100%;
Ca: 0% to 0.010%;
REM: 0% to 0.300%; and
a remainder: Fe and impurities.

6. The hot stamping member according to claim 5, wherein the chemical composition of the base material contains, by mass %, one or more selected from:
Cu: 0.005% to 1.00%;
Ni: 0.005% to 1.00%;
Nb: 0.010% to 0.150%;
V: 0.005% to 1.000%;
Ti: 0.010% to 0.150%;
Mo: 0.005% to 1.000%;
Cr: 0.050% to 1.000%;
B: 0.0005% to 0.0100%;
Ca: 0.001% to 0.010%; and
REM: 0.001% to 0.300% or less.

7. A hot stamping member comprising:
a base material; and
a plating region provided on the base material,
wherein the plating region has, in this order from a surface of the plating region:
a region A, which is defined as a region where a Ni content is 50 mass % or more,
a region B, which is defined as a region where a Ni content is less than 50 mass %, an Al content is 10 mass % or more, and an Fe content is 50 mass % or less, and
a region C, which is defined as a region where an Al content is 10 mass % or more and an Fe content is more than 50 mass %, and wherein
in a region from the surface of the plating region to a position 100 nm from the surface of the plating region in a thickness direction,
a maximum value of a Ni content is 50 mass % or more,
an Fe content is 10 mass % or less,
a Cr content is 6 mass % or less, and
a ratio Ni/Cr of the Ni content to the Cr content is 15 or more,
in a region from the position 100 nm from the surface of the plating region in the thickness direction to a position 500 nm from the surface of the plating region in the thickness direction,
a maximum value of a Ni content is 5 mass % or more, and
an Fe content is 25 mass % or less, and
in a region from the position 500 nm from the surface of the plating region in the thickness direction to a position 1000 nm from the surface of the plating region in the thickness direction,
a maximum value of a Ni content is 1 mass % or more, and
an Fe content is 30 mass % or less.

* * * * *